US007461932B2

(12) United States Patent
Iwasaki et al.

(10) Patent No.: US 7,461,932 B2
(45) Date of Patent: Dec. 9, 2008

(54) INK JET PRINTING APPARATUS FOR PREVENTING DEGRADATION OF LIQUID APPLICATION MEMBER

(75) Inventors: Osamu Iwasaki, Tokyo (JP); Naoji Otsuka, Yokohama (JP); Yoshinori Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 469 days.

(21) Appl. No.: 11/050,747

(22) Filed: Feb. 7, 2005

(65) Prior Publication Data

US 2005/0179720 A1 Aug. 18, 2005

(30) Foreign Application Priority Data

Feb. 12, 2004 (JP) ..... 2004-035806

(51) Int. Cl.
*B41J 2/01* (2006.01)
*B41J 29/393* (2006.01)

(52) U.S. Cl. ..... 347/101; 347/103; 347/19

(58) Field of Classification Search ..... 347/56, 347/98, 101, 103, 105, 155, 156, 165, 212, 347/19, 21, 23; 118/46
See application file for complete search history.

(56) References Cited

U.S. PATENT DOCUMENTS 5,367,982 A * 11/1994 DeMoore et al. ..... 118/46
6,183,079 B1 * 2/2001 Meade et al. ..... 347/101
6,585,364 B2 * 7/2003 Kasperchik et al. ..... 347/98
6,783,228 B2 * 8/2004 Szumla et al. ..... 347/103
7,105,203 B1 9/2006 Masuda et al.
7,240,983 B2 * 7/2007 Kojima ..... 347/23
7,270,409 B2 * 9/2007 Iwasaki et al. ..... 347/103

FOREIGN PATENT DOCUMENTS

| | | | |
|---|---|---|---|
| CN | 1079689 | A | 12/1993 |
| CN | 1263798 | A | 8/2000 |
| EP | 574124 | A1 * | 12/1993 |
| JP | 4-222657 | | 8/1992 |
| JP | 7-096603 | | 4/1995 |
| JP | 8-025617 | | 1/1996 |
| JP | 8-58069 | | 3/1996 |
| JP | 8-72227 | | 3/1996 |
| JP | 2001-70858 | | 3/2001 |
| JP | 2002-96452 | | 4/2002 |
| JP | 2002-517341 | | 6/2002 |

* cited by examiner

*Primary Examiner*—Stephen D Meier
*Assistant Examiner*—Rene Garcia, Jr.
(74) *Attorney, Agent, or Firm*—Fitzpatrick, Cella, Harper & Scinto

(57) ABSTRACT

A liquid applying apparatus can prevent an applying roller from being degraded while contacting with an application liquid for a long time. Specifically, once an applying operation has been completely executed on an applying medium, the apparatus stands by for 60 seconds while holding the application liquid in a liquid holding member. When an applying instruction is not given during this period, the apparatus performs an application liquid collecting operation of discharging the application liquid from the liquid holding member. Thus, upon determining that no applying operation has been performed for a certain period after one applying operation has finished, the apparatus collects the application liquid from the liquid holding member. This avoids immersing the applying roller in the application liquid for a long time. Therefore, the applying roller is prevented from being degraded by the application liquid.

4 Claims, 27 Drawing Sheets

INK JET PRINTING APPARATUS FOR PREVENTING DEGRADATION OF LIQUID APPLICATION MEMBER

BACKGROUND OF THE INVENTION

1. Field of the Invention

The present invention relates to a liquid applying apparatus and an ink jet printing apparatus, and specifically, to a liquid applying apparatus that applies a liquid to a medium for a predetermined purpose, for example, for starting the coagulation of pigments earlier when printing is carried out using inks composed of the pigments as color materials. Likewise, the present invention relates to an ink jet printing apparatus comprising a mechanism that applies the liquid to a print medium used for ink jet printing, for a predetermined purpose, for example, for starting the coagulation of pigments earlier when printing is carried out using inks composed of the pigments as color materials.

2. Description of the Related Art

A spin coater, a roll coater, a bar coater, and a die coater are known as systems for applying a liquid or an aqueous material to various media. These applying systems are premised on continuous applying on relatively long applying media. Thus, for example, in applying liquid to media having a relatively small size and being intermittently conveyed paint beads may be disturbed at a position at which applying is started or ended. In this case, the coats obtained may be non-uniform among the applying media.

A known configuration that can solve this problem is described in Japanese Patent Application Laid-open No. 2001-070858. On the basis of the die coater system, this configuration uses a rotating rod bar and ejects a paint to the rod bar through an ejection slit to form a coat on the rod bar. The coat formed is contacted with and transferred to an applying medium as the rod bar rotates. In this case, when the coat formed on the rod bar is not transferred or applied to the applying medium, the paint is returned to a head by the rotation of the rod bar. The paint is then collected via a collecting slit. In other words, the rod bar continues to rotate even during non-applying, while the paint is being formed into a coat on the rod bar. This enables a uniform coat to be obtained even if applying media are intermittently supplied and applied the paint.

Even in the field of ink jet printing apparatuses, those using a liquid applying mechanism are known. Japanese Patent Application Laid-open No. 2002-517341 describes an apparatus which uses a doctor blade contacting with a roller and in which the application liquid is collected between the blade and the roller so that the application liquid is applied to the roller as the roller rotates. As the roller rotates, the application liquid applied to the roller is transferred and applied to a support conveyed between this roller and another roller. Japanese Patent Application Laid-open No. 08-072227 (1996) similarly discloses a mechanism in an ink jet printing apparatus which applies a treatment liquid before printing which liquid insolubilizes dyes. In Embodiment 1 of this document, the treatment liquid in a replenishing tank is pumped by being attached to the rotating roller. At the same time, the treatment liquid pumped is applied to print paper.

However, in the configurations described in the above patent documents, an application liquid is applied or supplied to the surface of the rod bar or roller. However, the part of the rod bar or roller to which the application liquid is applied or supplied is open to or in communication with air. Thus, disadvantageously, the application liquid may be evaporated or, for example, the application liquid may leak when the posture of the apparatus is changed.

In particular, with an ink jet printing apparatus such as a printer, in view of, for example, the leakage of the liquid caused by a change in the posture of the apparatus, it is difficult to apply the applying mechanism described in the above documents to the apparatus if its size has been reduced.

In contrast, Japanese Patent Application Laid-open No. 08-058069 (1996) discloses a configuration that seals a part that applies or supplies inks, that is, application liquids, to a roller. The applying mechanism described in this document operates in a gravure printing apparatus to apply inks to a roller (applying roller) having the surface of which is formed with a pattern of a printing plate. This mechanism uses an ink chamber having two doctor blades arranged at two vertical positions along a peripheral surface of the roller and extending in a longitudinal direction of the roller and elastic members provided at the opposite sides of the two doctor blades. The chamber is contacted with the peripheral surface of the roller to form a liquid chamber between the ink chamber and the roller. Then, the roller is rotated to apply or supply the application liquid from the liquid chamber to the roller.

However, in any of the configurations described in Japanese Patent Application Laid-open No. 08-58069(1996) and other documents described above, while applying a liquid is not carried out, an applying roller that applies the liquid directly to a medium or the roller that supplies the application liquid to the applying roller remains soaked in a predetermined amount of application liquid gathered. Thus, if applying the liquid is not carried out for a long time, there are problems that the roller soaked in the application liquid may be degraded and non-uniform application is caused in a subsequent application operation.

Meanwhile, in the case that an application of the liquid is continuously executed for a plurality of media, it is desirable that the applying roller that applies the liquid directly to the medium or the roller that supplies the application liquid to the applying roller remains soaked in the application liquid and is ready for the next applying operation, for serving as their applying or supplying roller.

SUMMARY OF THE INVENTION

The present invention can provide a liquid applying apparatus and an ink jet printing apparatus which can solve the problems attributed to a long time contact of an applying member such as an applying roller with an application liquid.

In the first aspect of the present invention, there is provided a liquid applying apparatus, which is provided with an applying member for applying a liquid to a medium while the applying member moving and a liquid holding member for holding a liquid to be applied in a condition that the liquid to be applied contacts with a part of the applying member, for applying the liquid using the applying member, the apparatus comprising:

discharging means for discharging the liquid held by the liquid holding member from the liquid holding member, wherein the discharging means discharges the liquid from the liquid holding member, when predetermined timing comes within a period during which an application of the liquid to the medium with the applying member is not executed.

In the second aspect of the present invention, there is provided an ink jet printing apparatus that ejects ink to a printing medium to perform printing, the apparatus comprising:

applying means, which is provided with an applying member for applying a predetermined liquid to the printing medium and a liquid holding member for holding the predetermined liquid in a liquid holding space formed by an applying surface of the applying member being contacted, for applying the predetermined liquid held in the liquid holding space to the printing medium through the applying surface by rotating the applying surface;

printing means for causing a printing head to eject the ink to the printing medium to which the predetermined liquid has been applied by the applying means so as to print an image; and discharging means for discharging the predetermined liquid held by the liquid holding member from the liquid holding member, wherein the discharging means discharges the predetermined liquid form the liquid holding member when an application of the predetermined liquid to the medium with the applying member is not executed.

In the third aspect of the present invention, there is provided a control method for a liquid applying apparatus, which is provided with an applying member for applying a liquid to a medium while the applying member moving and a liquid holding member for holding a liquid to be applied in a condition that the liquid to be applied contacts with a part of the applying member, for applying the liquid using the applying member, the method comprising the step of:

discharging the liquid held by the liquid holding member from the liquid holding member, wherein the discharging step discharges the liquid from the liquid holding member, when predetermined timing comes within a period during which an application of the liquid to the medium with the applying member is not executed.

In the fourth aspect of the present invention, there is provided a control method for an ink jet printing apparatus having (A) a liquid applying mechanism, which is provided with an applying member for applying a predetermined liquid to a printing medium while the applying member moving and a liquid holding member for holding the predetermined liquid to be applied in a condition that the liquid to be applied contacts with a part of the applying member, for applying the liquid using the applying member, and (B) a printing mechanism for ejecting ink to the printing medium to which the predetermined liquid has been applied by the liquid applying mechanism to perform printing, the method comprising the step:

discharging the predetermined liquid held by the liquid holding member from the liquid holding member, wherein the discharging means discharges the predetermined liquid form the liquid holding member, when an application of the predetermined liquid to the medium with the applying member is not executed.

With the above configuration, when applying a liquid to a medium by using the applying member such as an applying roller is not carried out, the liquid is discharged from the liquid holding means. Consequently, in the case that the period of not carrying out the application is a relatively long time, it is possible to prevent the applying member from being soaked in the liquid during that time.

As a result, problems such as the degradation of the applying member, which are attributed to a long time contact of the applying member with the application liquid, can be prevented.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will be described below in detail with reference to the accompanying drawings.

Figure 1:
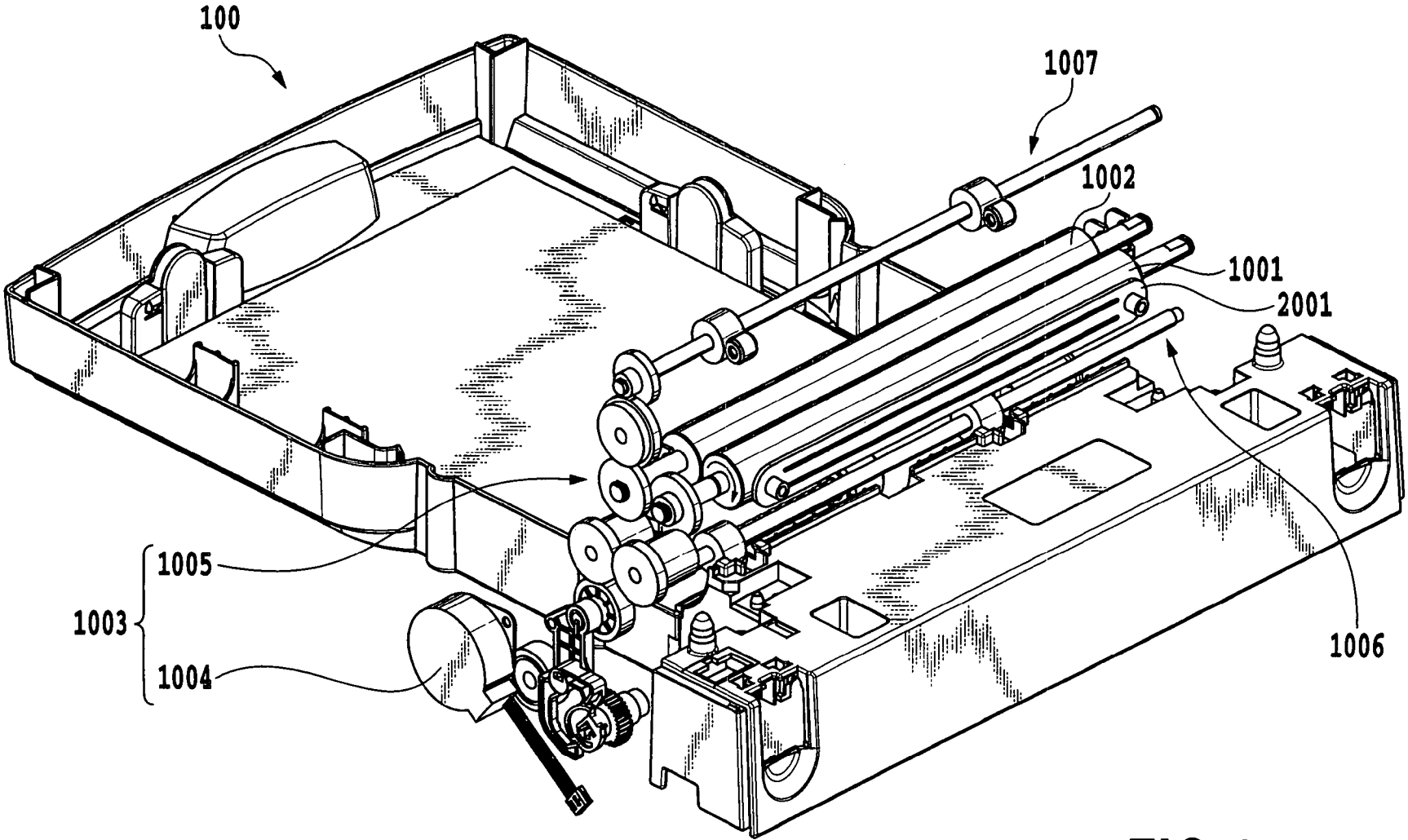
FIG. 1 is a perspective view generally showing the configuration of an embodiment according to a liquid applying apparatus of the present invention.

FIG. 1 is a perspective view generally showing the configuration of an embodiment according to a liquid applying apparatus 100 of the present invention. The liquid applying apparatus shown in FIG. 1 roughly has liquid applying means for applying a predetermined application liquid to a medium to which a liquid is to be applied (this medium will be referred to as an applying medium in the description below) and liquid supplying means for supplying an application liquid to the liquid applying means.

The liquid applying means has a cylindrical applying roller 1001, a cylindrical counter roller (medium supporting member) placed opposite the applying roller 1001, and a roller driving mechanism 1003 that drives the applying roller 1001. The roller driving mechanism 1003 comprises a roller driving motor 1004 and a transmission mechanism 1005 which transmits the driving force of the roller driving motor 1004 to the applying roller 1001 and which has a gear train and the like.

The liquid supplying means has, for example, a liquid holding member 2001 that holds the application liquid between the liquid holding member 2001 and a peripheral surface of the applying roller 1001, and a liquid channel 3000 (not shown in FIG. 1) described later and through which the liquid is supplied to the liquid holding member 2001. The applying roller 1001 and the counter roller 1002 are rotatively movably supported by respective shafts which are parallel to each other and each of which has opposite ends rotatively movably attached to a frame (not shown). Further, the liquid holding member 2001 extends almost all along the applying roller 1001 in a longitudinal direction. The liquid holding member 2001 is movably attached to the frame via a mechanism that enables the liquid holding member 2001 to contact with and separate from the peripheral surface of the applying roller 1001.

The liquid applying apparatus according to the present embodiment further comprises an applying medium supplying mechanism 1006 which consists of a pickup roller or the like to convey an applying medium to a nip portion between the applying roller 1001 and the counter roller 1002. Further, in a conveying path for applying media, a sheet discharging mechanism 1007 consisting of a sheet discharging roller or the like is provided downstream of the applying roller 1001 and the counter roller 1002 to convey a applying medium on which the application liquid has been applied, to a sheet discharging section (not shown). Like the applying roller and the like, the sheet supplying mechanism and the sheet discharging mechanism are operated under the driving force of the driving motor 1004 transmitted via the transmission mechanism 1005.

The application liquid used in the present embodiment is intended to facilitate the coagulation of pigments when printing has been carried out using inks including the pigments as color materials.

An example of the components of the application liquid is shown below.

Tetrahydrate of calcium nitrate: 10%
Glycerin: 42%
Surface active agent: 1%
Water: remaining amount The application liquid has a viscosity of 5 to 6 cp (centipoise) at 25° C.

In applications of the present invention, of course, the application liquid is not limited to the one described above. For example, a liquid including a component which insolubilizes or coagulate a dye may be used as another application liquid.

If water is used as a liquid to be applied, the slidability of the abutting portion between the applying roller and the liquid holding member according to the present invention is improved by containing a component that reduces surface tension in the liquid. In the above example of the components of the liquid to be applied, the glycerin and the surface active agent are components that reduce the surface tension.

Now, a detailed description will be given of the elements of the sections of the applying apparatus described above in brief.

Figure 2:
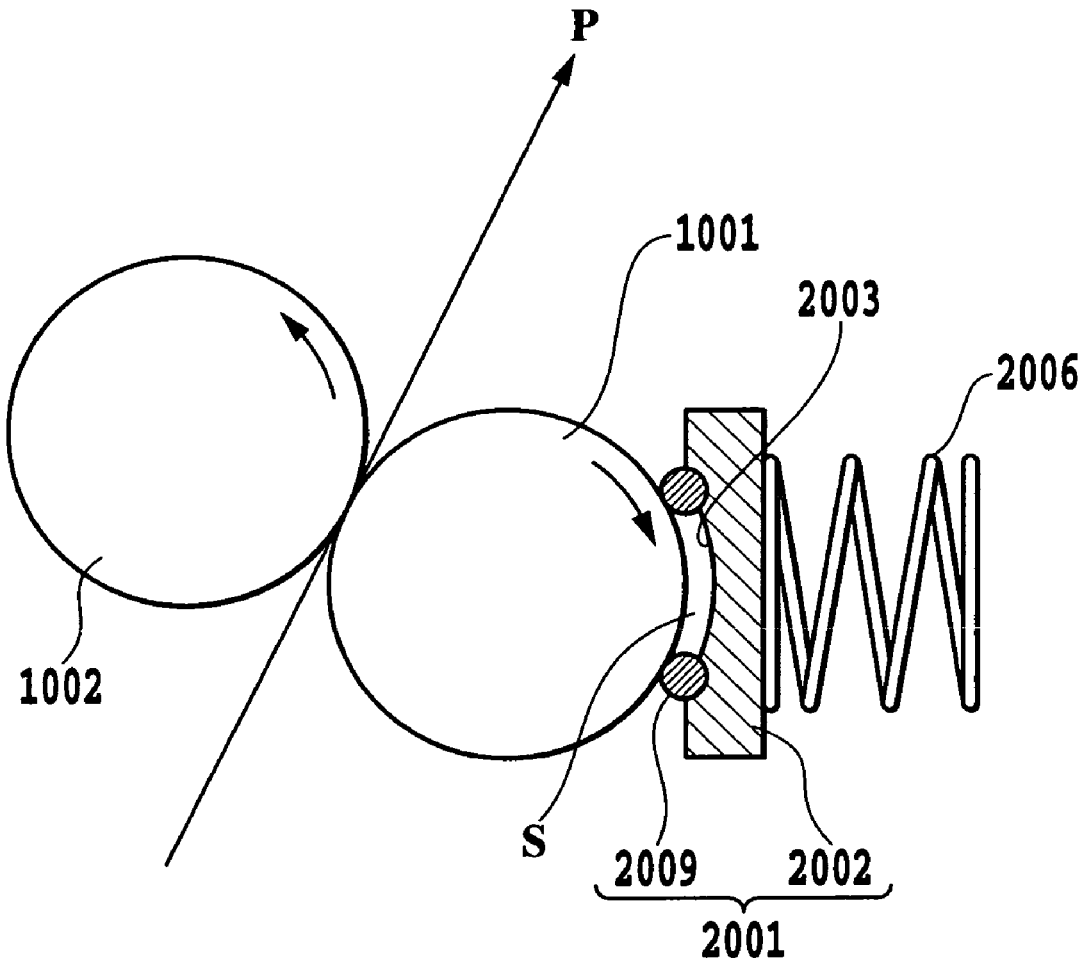
FIG. 2 is a vertical side view showing an example of the arrangement of an applying roller, a counter roller, and a liquid holding member which are shown in FIG. 1.

FIG. 2 is a sectional view, as seen from the side, illustrating an example of the arrangement of an applying roller 1001, a counter roller 1002, a liquid holding member 2001 or the like.

The counter roller 1002 is biased by biasing means (not shown) toward the peripheral surface of the applying roller 1001. By rotating the applying roller 1001 clockwise in the figure, it is possible to sandwich an applying medium P on which the application liquid is to be applied, between the rollers, while conveying the applying medium P in the direction of an arrow in the figure.

Further, when urged and abutted against the peripheral surface of the applying roller 1001 under the biasing force of a spring member (pressing means) 2006, the liquid holding member 2001 forms an elongate liquid holding space S extending all over an area applied the liquid by the applying roller 1001. The application liquid from a liquid channel 3000, described later, is supplied to the interior of the liquid holding space S via the liquid holding member 2001. In this case, since the liquid holding member 2001 is configured as described below, the application liquid can be prevented from inadvertently leaking from the liquid holding space S to the exterior while the applying roller 1001 is stopped.

FIGS. 3 to 8 show the configuration of the liquid holding member 2001.

Figure 3:
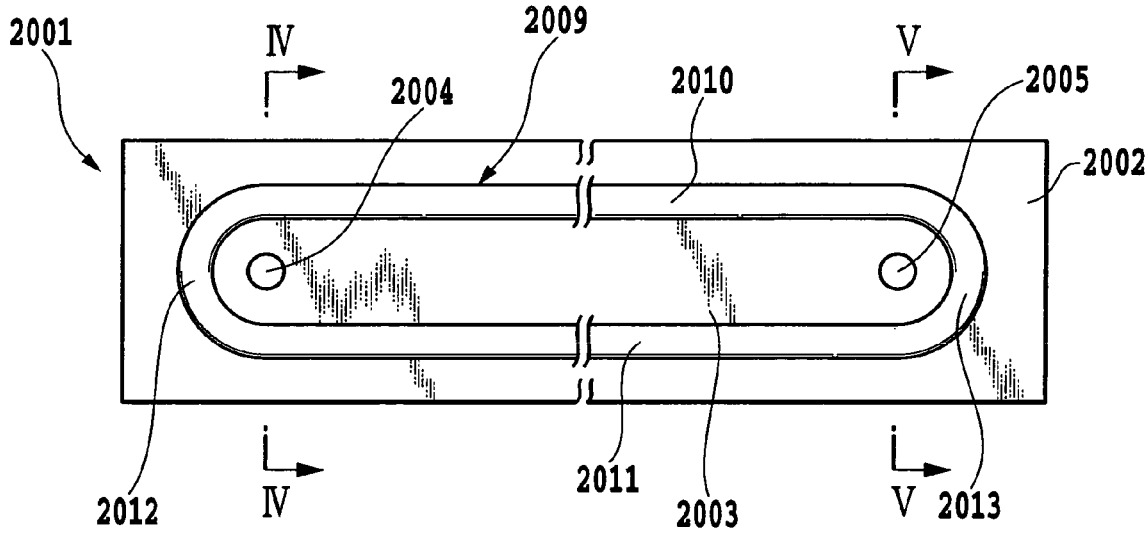
FIG. 3 is a front view of the liquid holding member shown in FIGS. 1 and 2.

As shown in FIG. 3, the liquid holding member 2001 has a space forming base material 2002 and an annular abutting member 2009 located on one surface of the space forming base material 2002. A concave portion 2003 is formed in a central portion of the space forming base material 2002 along its longitudinal direction; a bottom portion of the concave portion 2003 has a circular cross section. The abutting member 2009 has linear portions fastened along the upper edges of the concave portion 2003 and circumferential portions fastened so as to extend from the upper edge through the bottom portion to the opposite upper edge. Thus, when the abutting member 2009 of the liquid holding member 2001 abuts against the applying roller 1001, the abutment conforms to the shape of the peripheral surface of the applying roller. It is thus possible to achieve the abutment at a uniform pressure.

As described above, in the liquid holding member according to this embodiment, the abutting member 2009, formed integrally and seamlessly, is continuously abutted without a gap against the outer peripheral surface of the applying roller 1001 under the biasing force of the spring member 2006. As a result, the liquid holding space S is substantially closed by the abutting member 2009, one surface of the space forming base material, and the outer peripheral surface of the applying roller 1001. The liquid is held in this space. Then, when the rotation of the applying roller 1001 is stopped, the abutting member 2009 and the outer peripheral surface of the applying roller 1001 maintain a liquid tight state. The liquid can be reliably prevented from leaking to the exterior. On the other hand, when the applying roller 1001 is rotated, the application liquid can slipperily flow between the outer peripheral surface of the applying roller 1001 and the abutting member 2009 as described later. In this case, when the applying roller 1001 is stopped and the liquid tight state is established between the outer peripheral surface of the applying roller 1001 and the abutting member 2009, the liquid cannot flow out of the space as described above. In this case, the abutting state of the abutting member 2009 includes not only direct abutment against the outer peripheral surface of the applying roller 1001 but also abutment against the outer peripheral surface via a liquid film formed under a capillary force.

Figure 4:
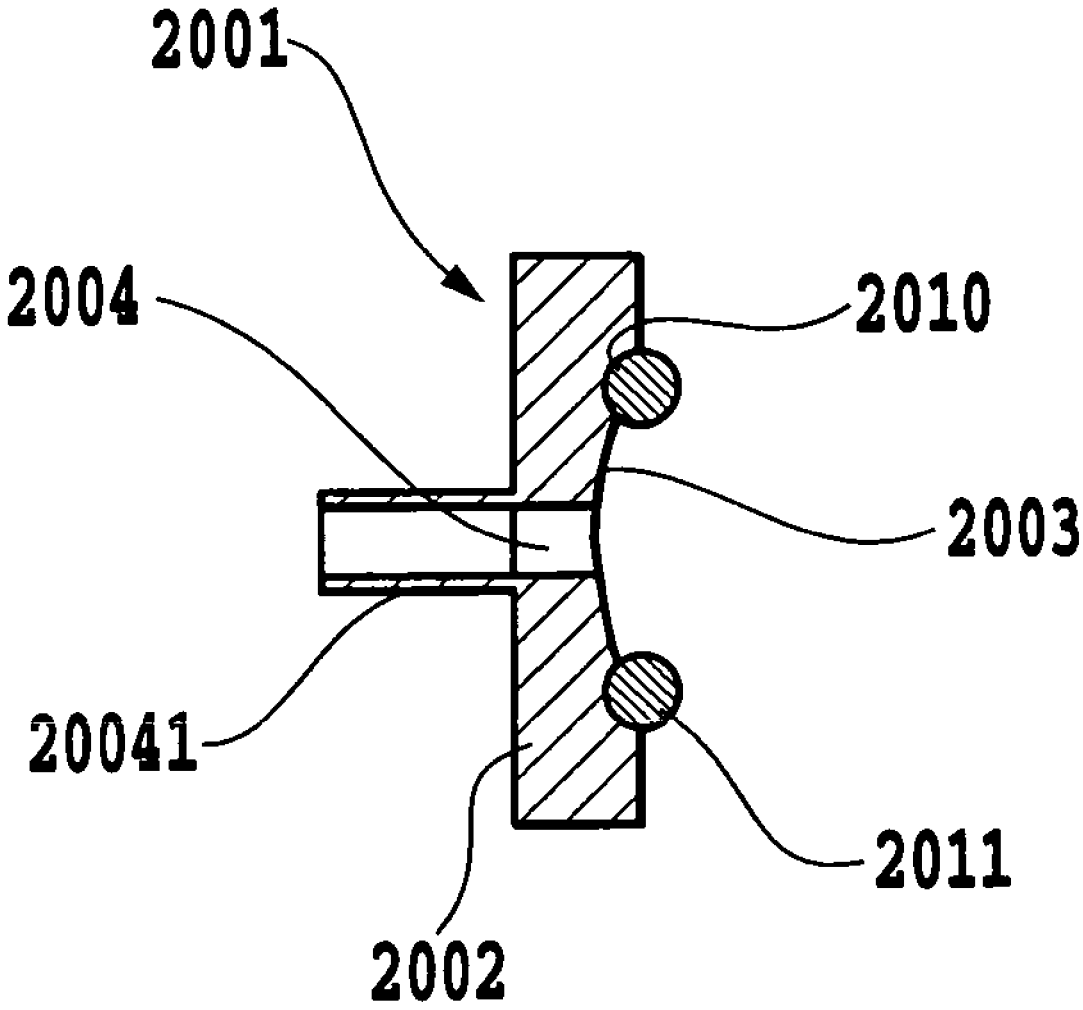
FIG. 4 is an end view showing an end surface of the liquid holding member shown in FIG. 3, the view taken along line IV-IV in FIG. 3.
Figure 5:
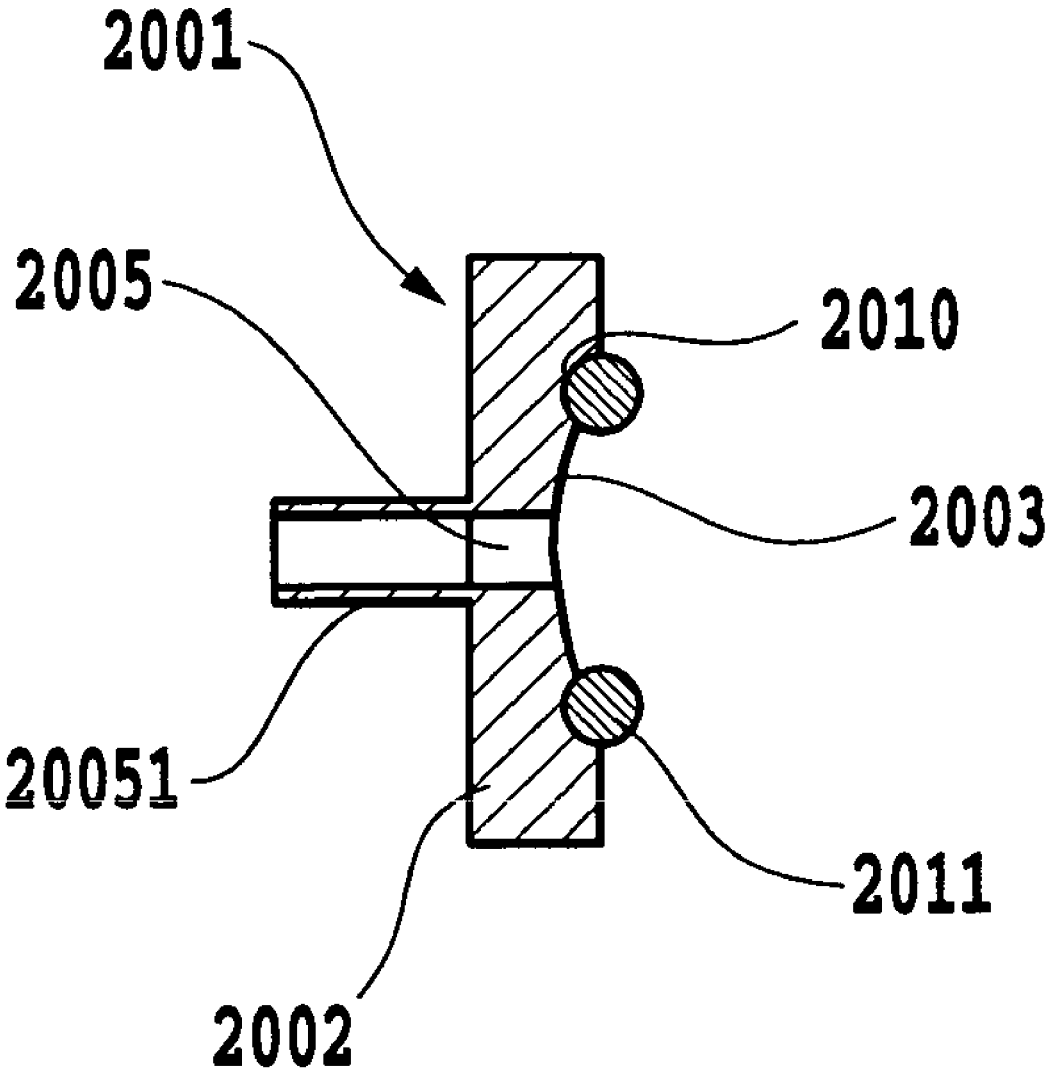
FIG. 5 is an end view showing the end surface of the liquid holding member shown in FIG. 3, the view taken along line V-V in FIG. 3.
Figure 6:
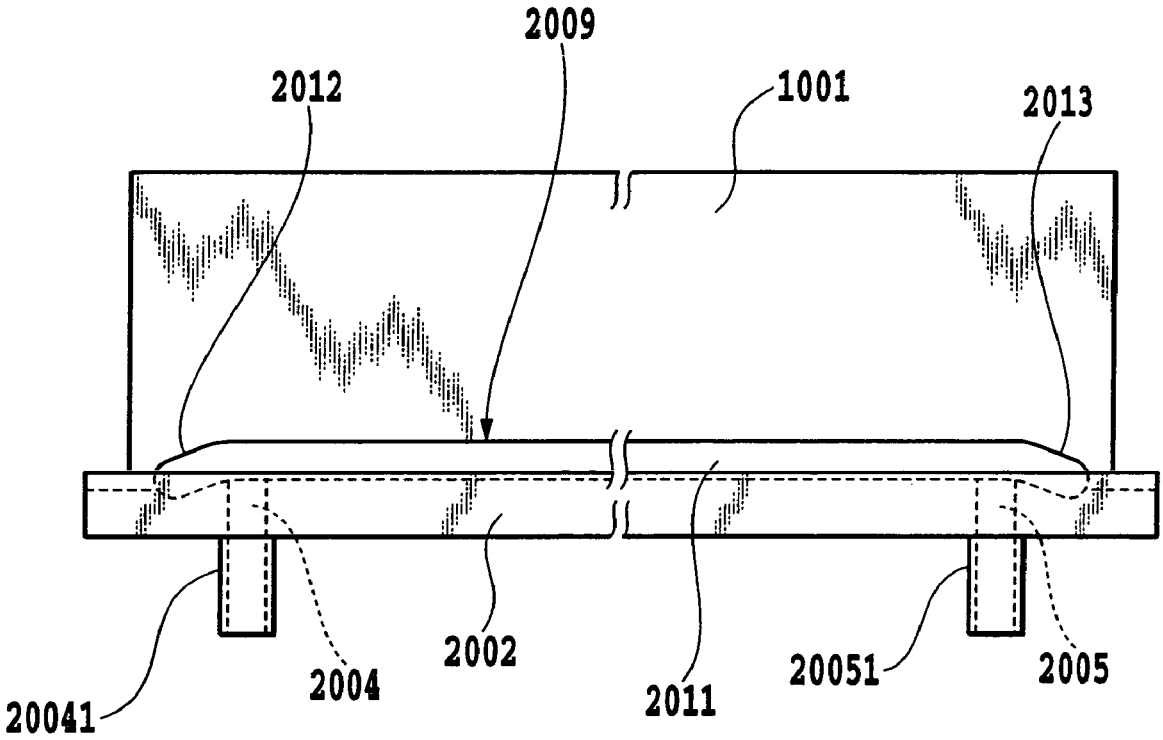
FIG. 6 is a plan view of the liquid holding member shown in FIG. 3.
Figure 7:
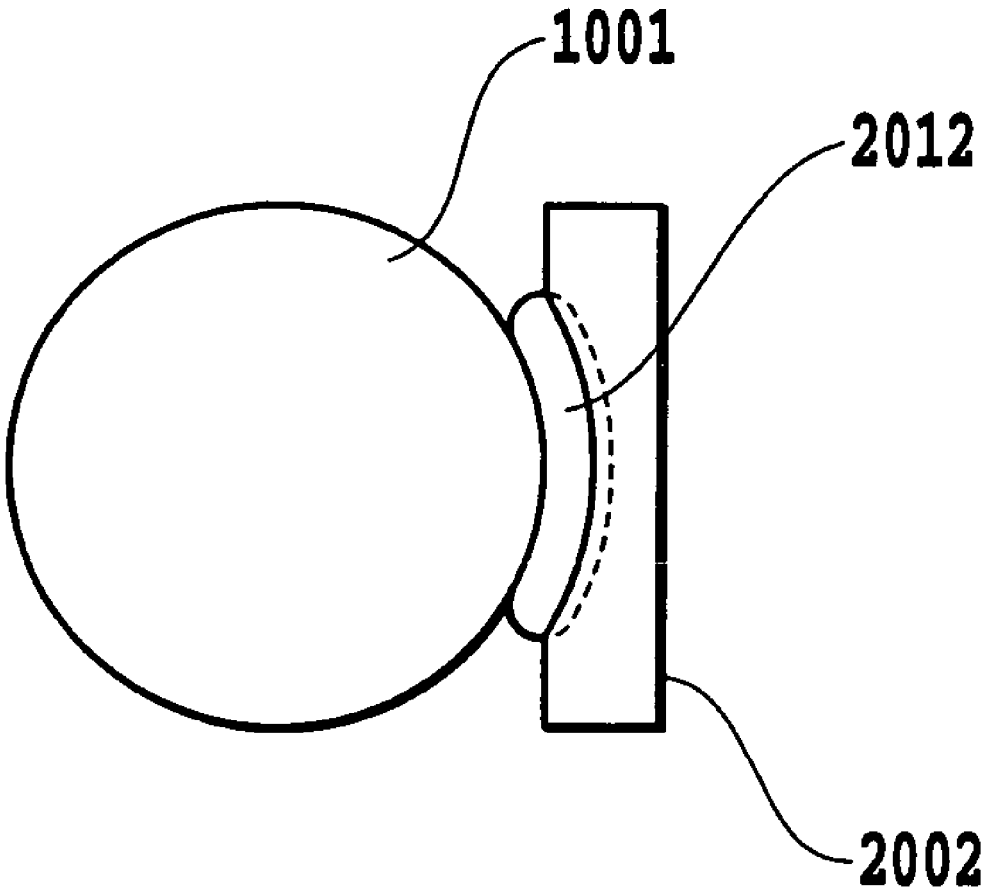
FIG. 7 is a left side view showing how an abutting portion of the liquid holding member shown in FIG. 3 is abutted against a liquid applying roller.
Figure 8:
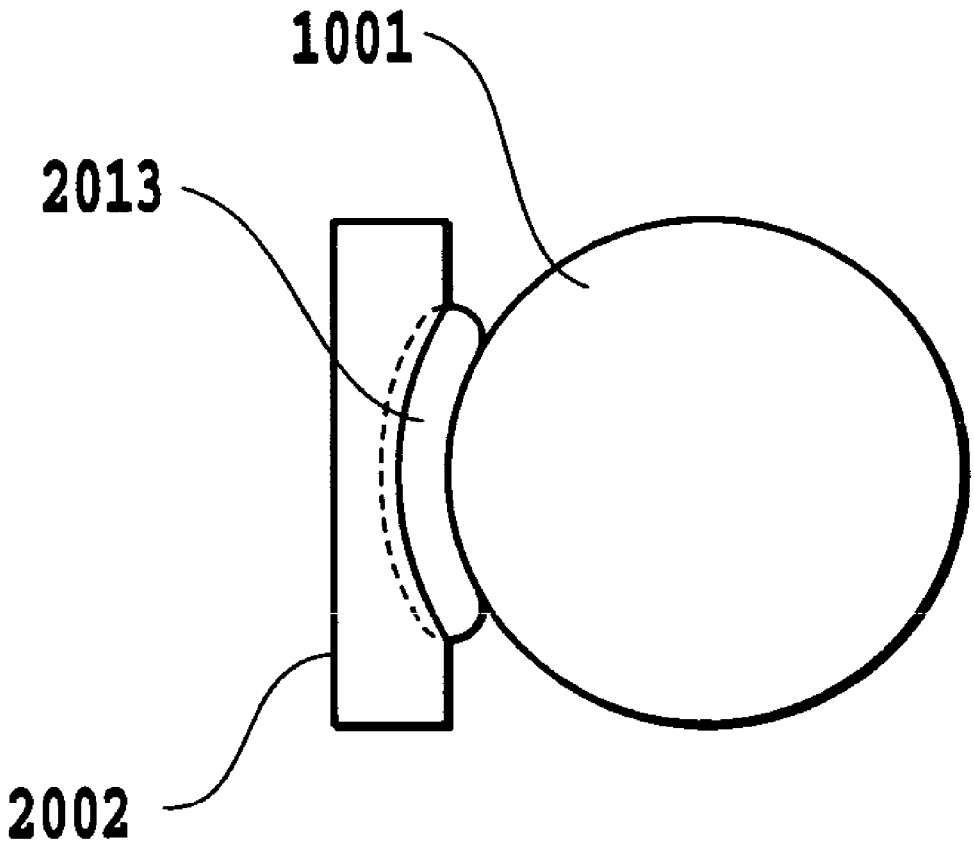
FIG. 8 is a right side view showing how the abutting portion of the liquid holding member shown in FIG. 3 is abutted against the liquid applying roller.

As shown in FIGS. 3 to 8, the longitudinally opposite sides of the abutting member 2009 are gently curved as viewed from its front (FIG. 3), from above (FIG. 6), or from its side (FIGS. 7 and 8). Thus, even when the abutting member 2009 is abutted against the applying roller 1001 under a relatively high pressure, the whole abutting member 2009 is substantially uniformly elastically deformed. This prevents large distortions locally. Thus, as shown in FIGS. 6 to 8, the abutting member 2009 abuts tightly without the gap against the outer peripheral surface of the applying roller 1001. As a result, a substantially closed space can be formed as described above.

On the other hand, as shown in FIGS. 3 to 5, a liquid supplying port 2004 and a liquid collecting port 2005 are formed in an area of the space forming base material 2002 which is surrounded by the abutting member 2009; the liquid supplying port 2004 and the liquid collecting port 2005 have holes penetrating the space forming base material 2002. The liquid supplying port 2004 and the liquid collecting port 2005 are communicating with cylindrical connecting portions 20041 and 20051 projected from a back surface of the space forming base material. Further, the connecting portions 20041 and 20051 are connected to a liquid channel 3000 described later. In this embodiment, the liquid supplying port 2004 is formed near one end of an area surrounded by the abutting member 2009 (the left end in FIG. 3), while the liquid collecting port 2005 is formed near the other end of the same area (the right end in FIG. 3). The liquid supplying port 2004 is used to supply the application liquid provided through the liquid channel 3000, to the liquid holding space S. The liquid collecting port 2005 is used to allow the liquid in the liquid holding space S to flow out to the liquid channel 3000. The supply and flowout of the application liquid allows the liquid to flow from the left end to right end of the liquid holding space S.

(Application Liquid Channel)

Figure 11:
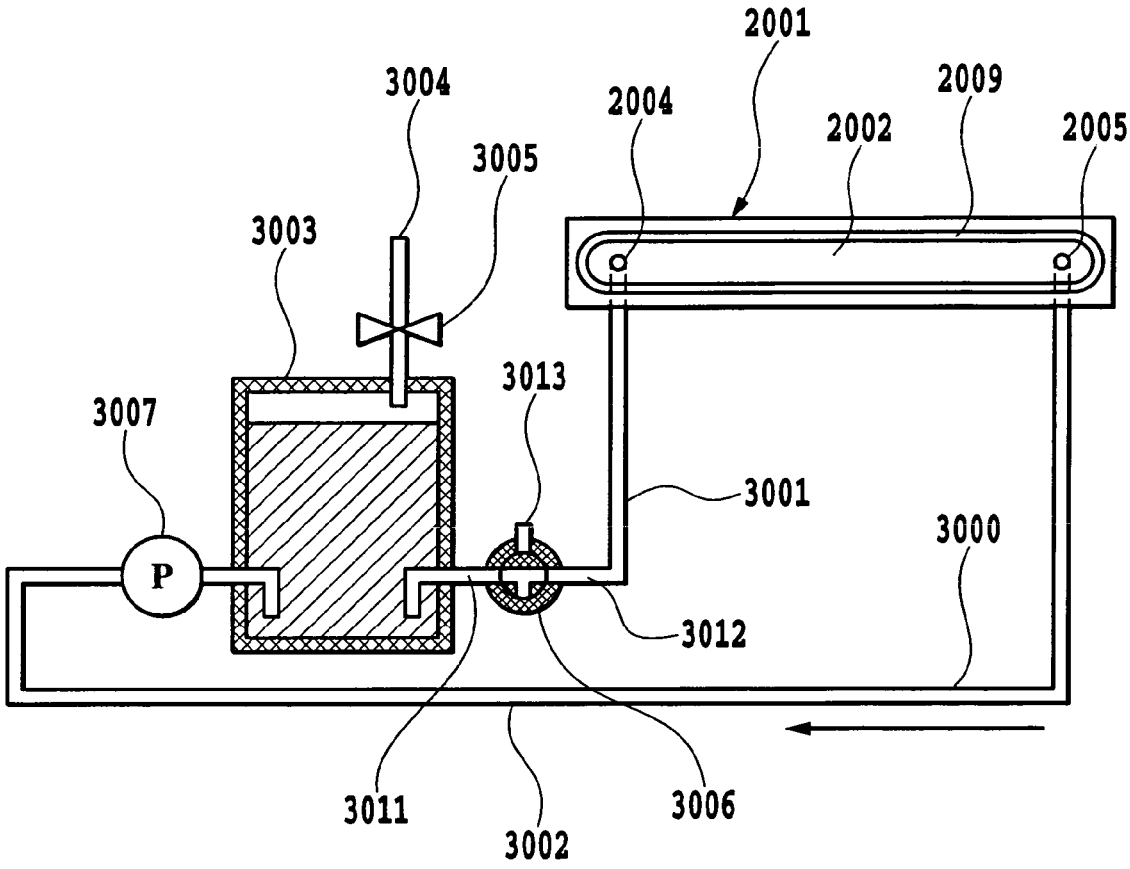
FIG. 11 is a diagram generally showing the configuration of a liquid channel in the liquid applying apparatus according to the embodiment of the present invention.

FIG. 11 is a diagram generally illustrating the configuration of the liquid channel 3000, connected to the liquid holding member 2001 of the application liquid supplying means.

The liquid channel 3000 has a first channel 3001 that connects the liquid supplying port 2004 of the space forming base member 2002, constituting the liquid holding member 2001, to a storage tank 3003 that stores the application liquid, a second channel 3002 that connects the liquid collecting port 2005 of the space forming base material 2002 to the storage tank 3003 together. An air communicating port 3004 is formed in the storage tank 3003. The air communicating port is provided with an air communicating valve 305 that switches between a communicating state for the air and a closed state for the same. The air communicating port 3004 desirably has a labyrinthine structure in order to inhibit evaporation. Further, the first channel 3001 is provided with a selector valve 3006. The selector valve 3006 switches between a communicating state of the first channel 3001 with the air and a closed state of the same. Moreover, the second channel 3002 connects to a pump 3007 used to force the application liquid and air to flow through the liquid channel 3000 in a desired direction. In this case, a flow of a liquid is generated which is directed from the first channel 3001 to the second channel 3002 via the liquid holding space S.

In this embodiment, the first channel 3001 and the second channel 3002 are formed of cylindrical tubes. An opening formed at an end of each tube is placed at the bottom of the storage tank 3003 or close to the bottom. The position of the opening allows the application liquid in the storage tank 3003 to be completely consumed.

Figure 22:
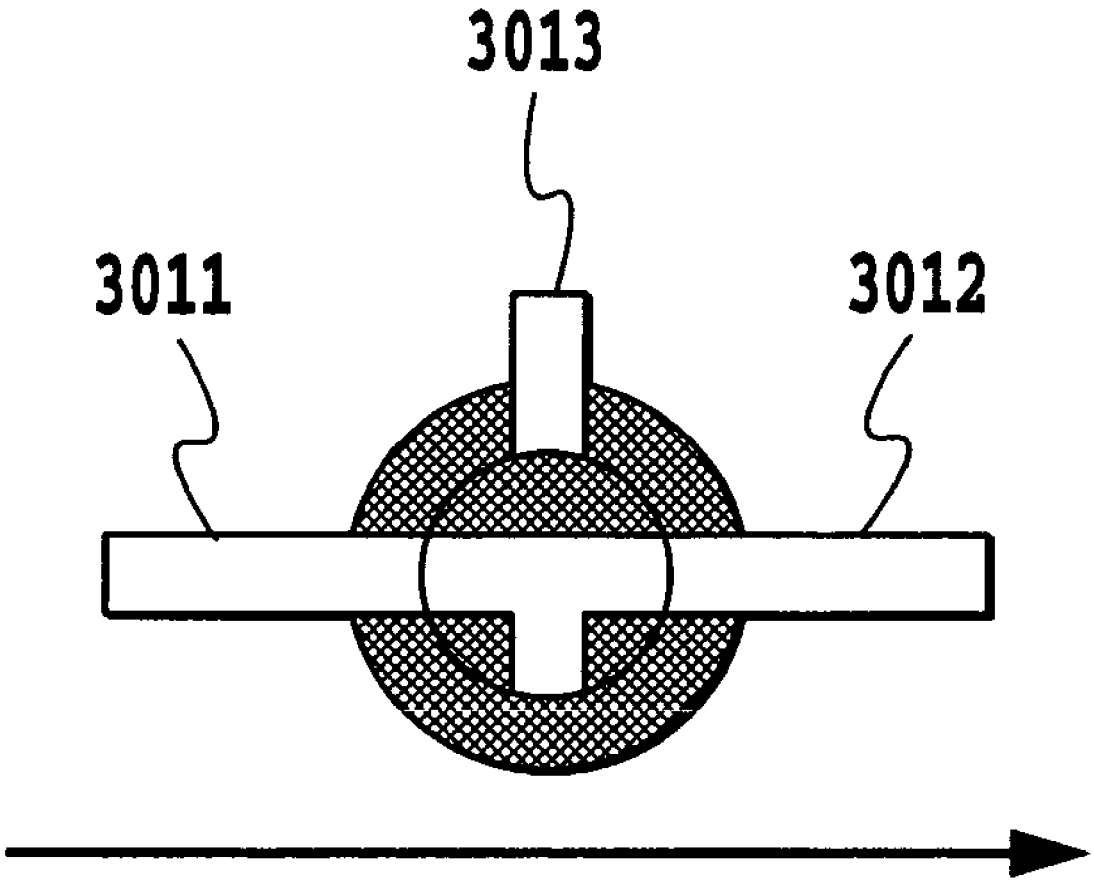
FIG. 22 is a diagram showing a state that tubes 3011 and 3012 communicate with each other through a three-way valve 3006.
Figure 23:
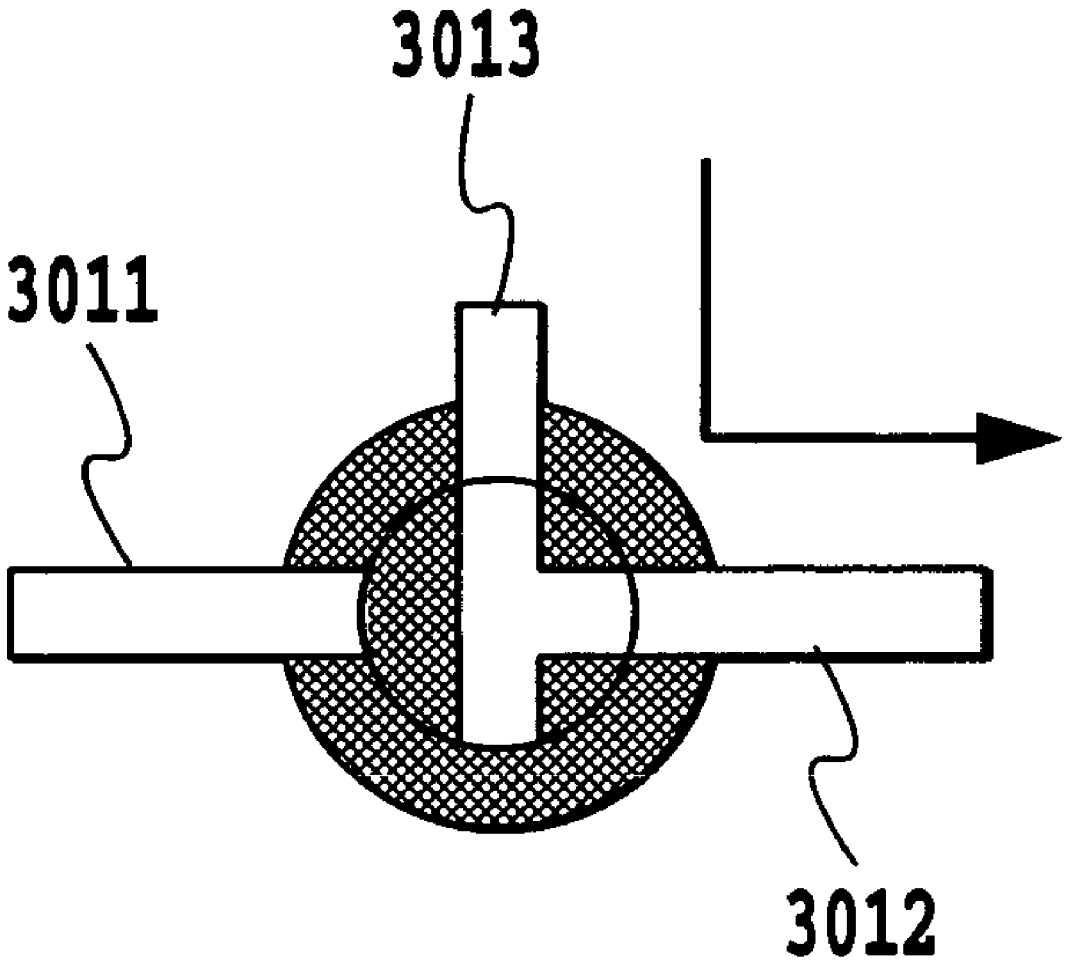
FIG. 23 is a diagram showing a state that a tube 3012 and an air communicating port 3013 communicate with each other through a three-way valve 3006.

According to this embodiment, various types of the selector valves 3006 are applicable provided that they selectively enable and disable the communication between the first channel 3001 and the air. In this case, a three-way valve is used as shown in FIG. 11. The three-way valve 3006 has three ports that are in communication with one another. It is possible to allow two of the three ports to selectively communicate with any two of the storage tank tube 3011 in the first channel 3001, liquid holding member tube 3012, and air communicating port 3013. The three-way valve 3006 is selectively switched between a connected state in which the tubes 3011 and 3012 are in communication with each other and a connected state in which the tube 3012 and the air communicating port 3013 are in communication with each other. This enables the application liquid in the storage tank 3003 or air obtained through the air communicating port 3013 to be selectively supplied to the space S formed by the liquid holding member 2001 and the applying roller 1001. Specifically, while the tubes 3011 and 3012 are in communication as shown in FIG. 22, the application liquid in the storage tank 3003 is supplied to the liquid holding space S. On the other hand, while the tube 3012 and the air communicating port 3013 are in communication as shown in FIG. 23, the air obtained through the air communicating port 3013 is supplied to the liquid holding space S. The switching of the three-way valve 3006 is carried out in accordance with a control signal from a control section 4000 described later. Thus, the application liquid is filled or supplied.

(Control System)

Figure 12:
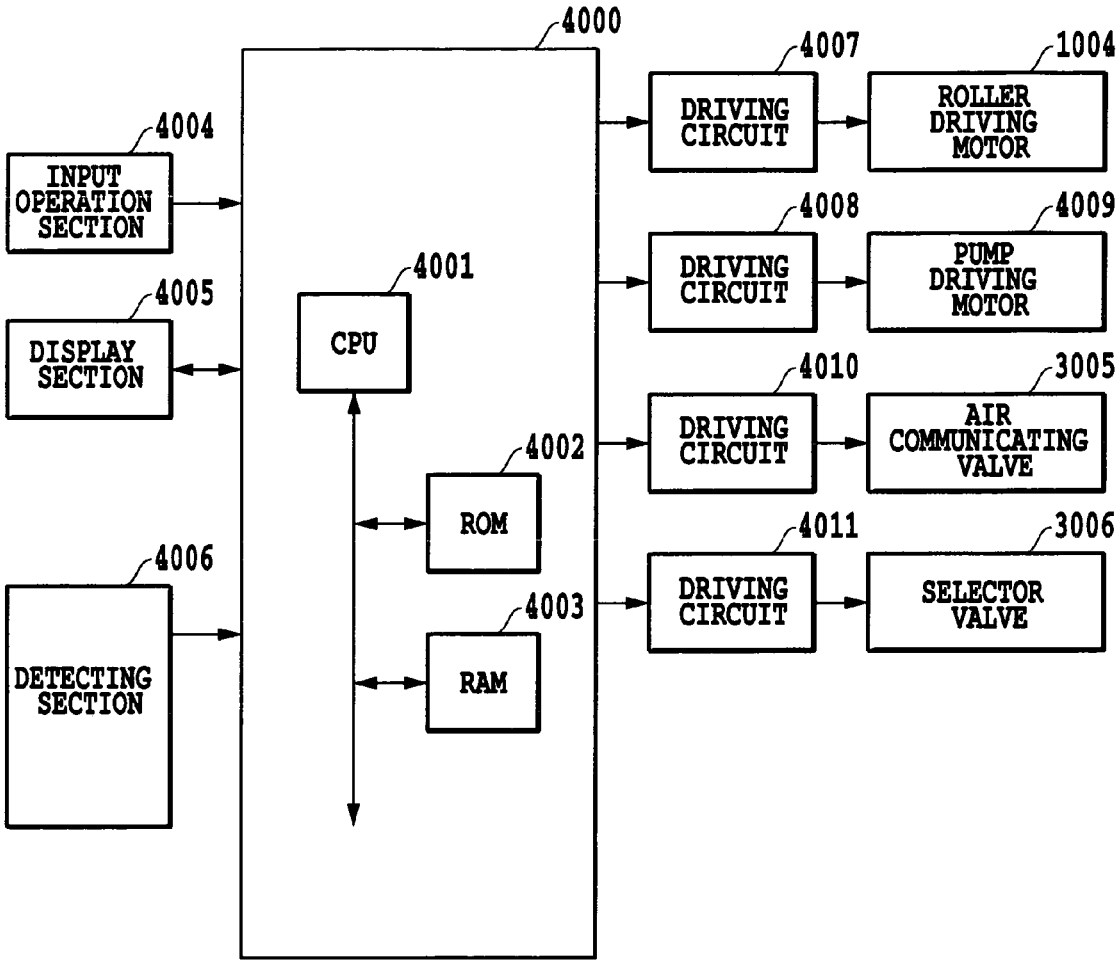
FIG. 12 is a block diagram generally showing the configuration of a control system according to the embodiment of the present invention.

FIG. 12 is a block diagram generally showing the configuration of the control system in the liquid applying apparatus according to the present embodiment.

In FIG. 12, the control section 4000 operates as control means for controlling the whole liquid applying apparatus.

The control section 4000 has a CPU 4001 that performs various process operations such as calculations, control, and determinations, a ROM 4002 that stores, for example, control programs for processes executed by the CPU 4001, such as the one described later in FIG. 13, and a RAM 4003 that temporarily stores data used during process operations of the CPU 4001 as well as input data.

The control section 4000 connects to an input operation section 4004 including a keyboard, various switches, or the like with which predetermined instructions or data are input, a display section 4005 that provides various displays including inputs to and the set state of the liquid applying apparatus, and a detecting section 4006 including a sensor or the like which detects the position of a applying medium or the operational state of each section. The control section 4000 also connects to the roller driving motor 1004, a pump driving motor 4009, an air communicating valve 3005, and the selector valve 3006, via driving circuits 4007, 4008, 4010, and 4011.

(Liquid Applying Operation Sequence)

Figure 13:
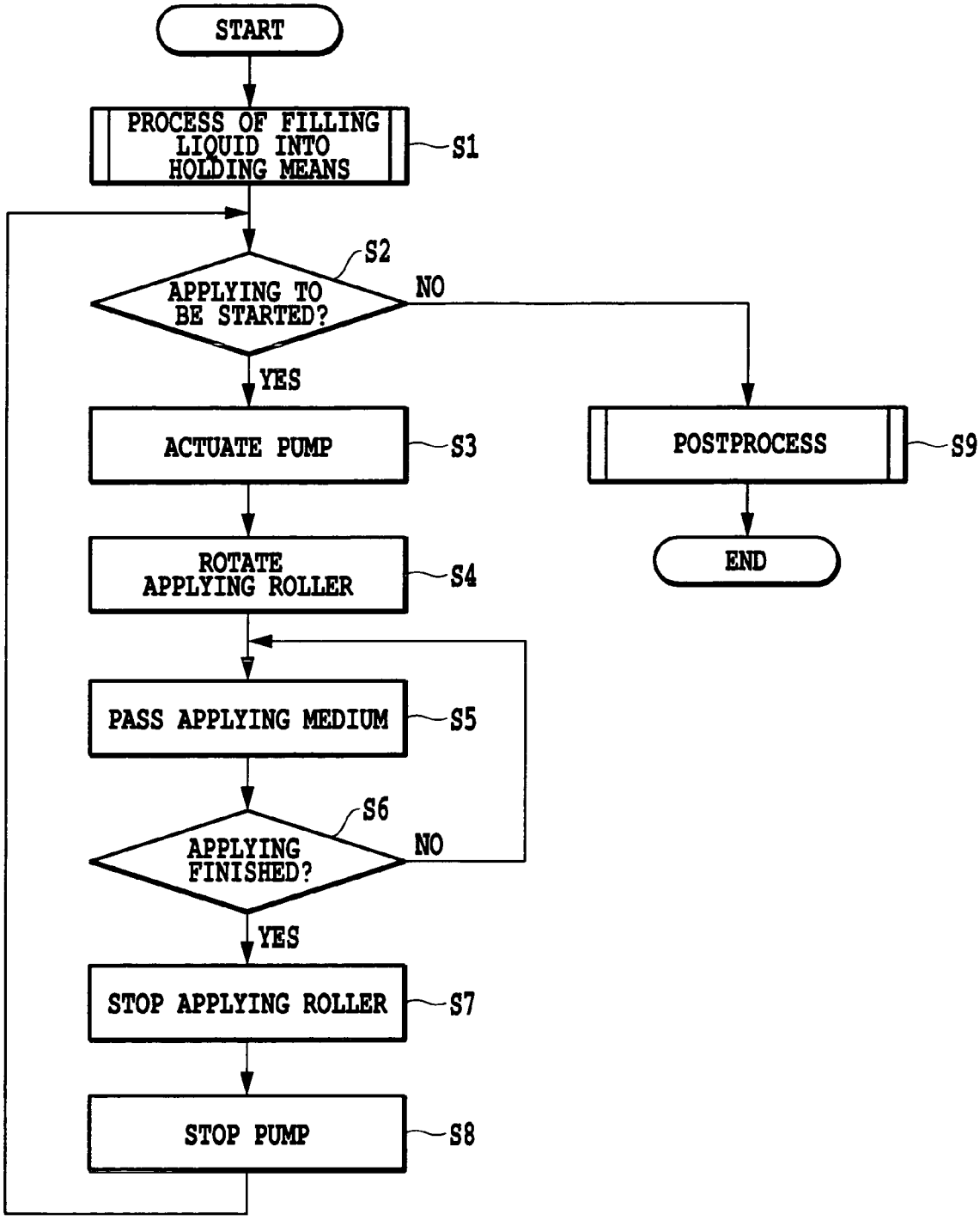
FIG. 13 is a flowchart showing a liquid applying operation sequence according to the embodiment of the present invention.

FIG. 13 is a flowchart showing a process procedure for applying a liquid in the liquid applying apparatus according to the present embodiment. The steps of liquid application will be described below with reference to this flowchart.

When the liquid applying apparatus is powered on, the control section 4000 executes an applying operation sequence described below, in accordance with the flowchart shown in FIG. 13.

Filling Step

In step S1, the liquid holding space S is filled with the application liquid. In this filling step, first the air communicating valve 3005 of the storage tank 3003 is opened for a communication with the air, and the pump 3007 is driven for a given length of time. Thus, if the liquid holding space S and the channels 3001 and 3002 have not been filled with the application liquid, the pump drives the air inside the space and channels out to the storage tank 3003. The air is then discharged to the exterior of the apparatus. These portions are then filled with the application liquid. On the other hand, if these portions have already been filled with the application liquid, the application liquid in these portions starts to flow. These portions are thus supplied with an application liquid having an appropriate concentration and viscosity. This initial operation allows the application liquid to be supplied to the applying roller 1001. It is thus possible to apply the application liquid to the applying medium.

Applying Step

Then, an applying start instruction is input (step S2). Then, the pump 3007 restarts operation (step S3). The applying roller starts rotating clockwise as shown by an arrow in FIG. 2 (step S4). The rotation of the applying roller 1001 causes the application liquid L filled into the liquid holding space S to slipperily flow between the applying roller 1001 and a lower edge 2011 of the abutting member 2009 against the pushing force of the abutting member 2009 of the liquid holding member 2001, which force acts on the applying roller 1001. The application liquid adheres to the outer periphery of the applying roller 1001 in layer form. The application liquid L adhering to the applying roller 1001 is transferred to the abutting portion between the applying roller 1001 and the counter roller 1002.

Figure 9:
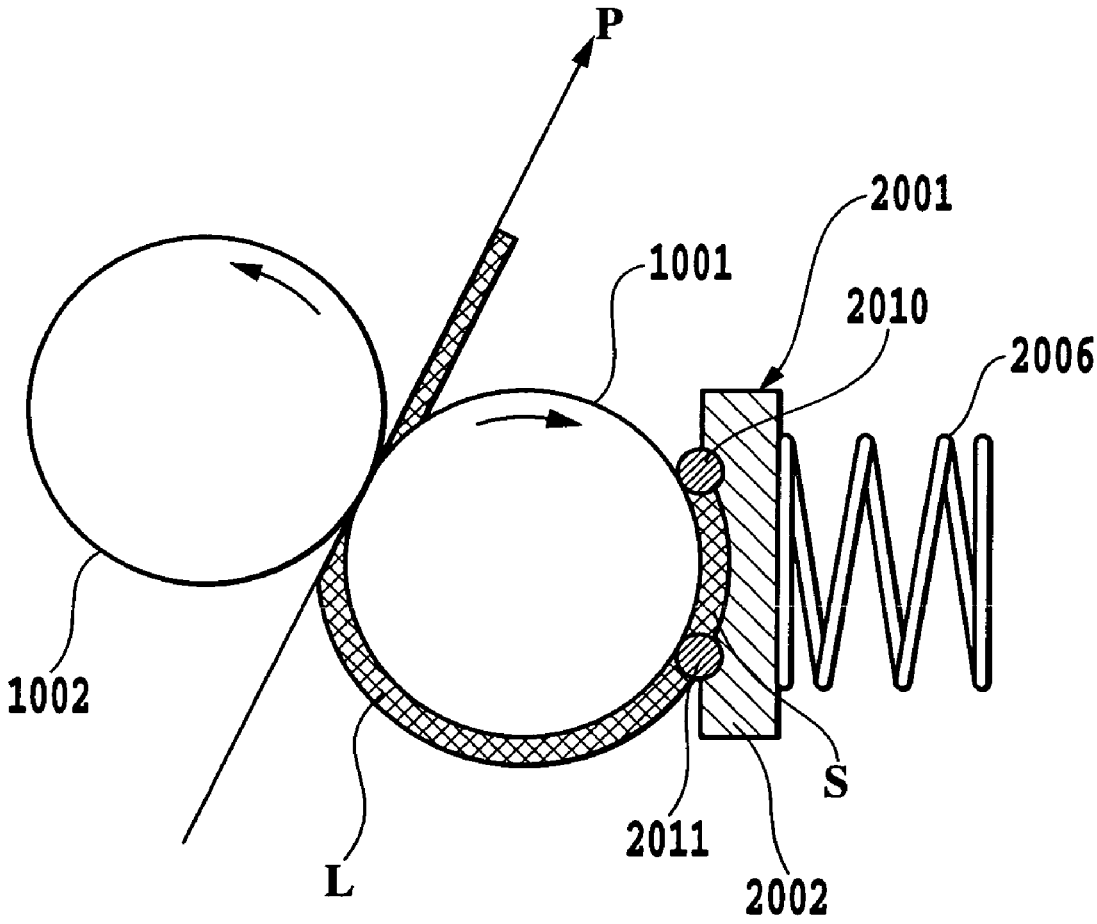
FIG. 9 is a vertical sectional view showing how an application liquid is filled into a liquid holding space formed by the liquid holding member and the applying roller and how a liquid is applied to an applying medium by the rotation of the applying roller.

Then, an applying medium supplying mechanism 1006 conveys an applying medium to between the applying roller 1001 and the counter roller 1002. The applying medium is inserted between these rollers and conveyed to a sheet discharging section as the applying roller 1001 and the counter roller 1002 rotate (step S5). During this conveyance, the application liquid applied to the peripheral surface of the applying roller is transferred from the applying roller 1001 to the applying medium P as shown in FIG. 9. Of course, means for supplying an applying medium to between the applying roller 1001 and the counter roller 1002 is not limited to the above supplying mechanism. It is possible to use any means, for example, manual means which uses a predetermined guide member or which is solely used.

In FIG. 9, an area with crossing oblique lines denote the application liquid L. In this case, the application liquid on the applying roller 1001 and applying medium P is shown considerably thicker than the actual one in order to clearly illustrate how the application liquid L is applied.

As described above, an applied part of the applying medium P is conveyed in the direction of the arrow under the conveying force of the applying roller 1001. Further, an unapplied part of the applying medium P is conveyed to the contact portion between the applying medium P and the applying roller 1001. This operation is continuously or intermittently performed to apply the application liquid to the entire applying medium.

FIG. 9 shows the ideal applied state in which the all of the application liquid L adhering to the applying roller 1001 after slipperily flowing out of the abutting member 2009 is transferred to the applying medium P. However, actually, not all of the application liquid L adhering to the applying roller 1001 is not transferred to the applying medium P. Specifically, when the applying medium P conveyed separates from the applying roller 1001, the application liquid L often also adheres to and remains on the applying roller 1001. The amount of application liquid L remaining on the applying roller 1001 varies depending on the material of the applying medium P or the state of fine concaves and convexes on the surface of the applying medium P. However, if the applying medium P is ordinary paper, the application liquid L remains on the peripheral surface of the applying roller 1001 after an applying operation.

Figure 25:
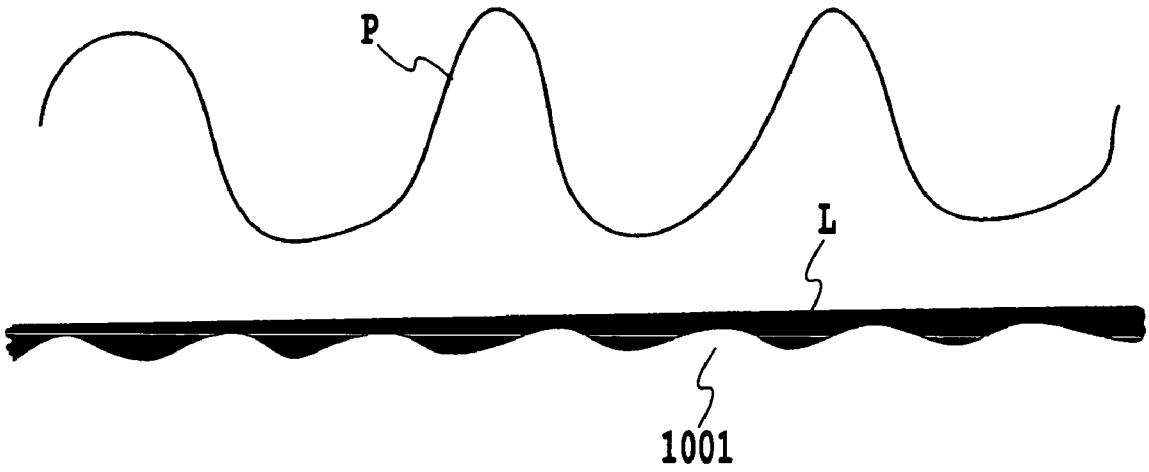
FIG. 25 is a diagram illustrating an applying process executed on a surface of a medium P as an ordinary paper and the applying surface of a roller.
Figure 26:
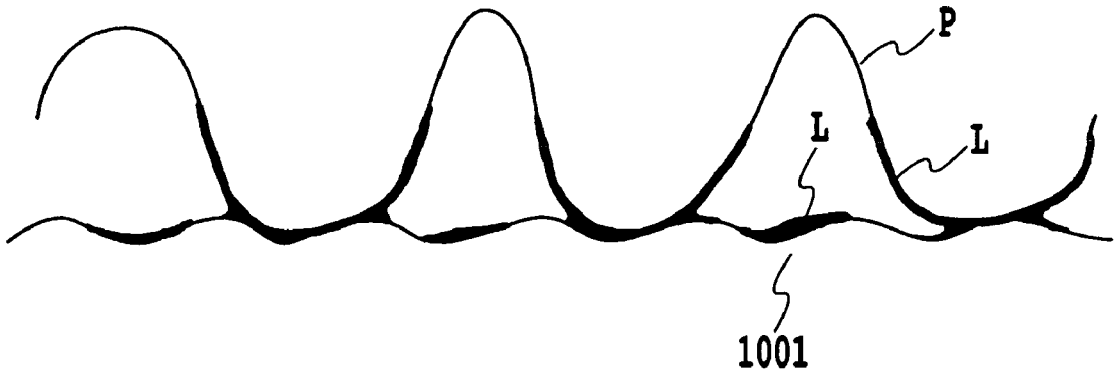
FIG. 26 is a diagram illustrating an applying process executed on a surface of a medium P as an ordinary paper and the applying surface of a roller.
Figure 27:
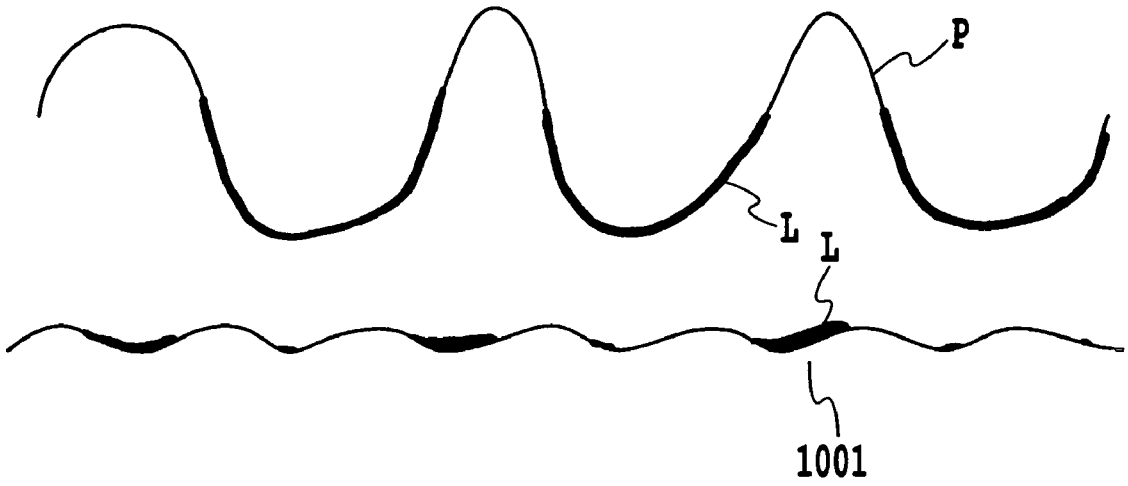
FIG. 27 is a diagram illustrating an applying process executed on a surface of a medium P as an ordinary paper and the applying surface of a roller.

FIGS. 25, 26, and 27 are diagrams illustrating the process of applying between a surface of the medium P and an applying surface in the case where the medium is ordinary paper. In these figures, the liquid is painted over with black.

FIG. 25 shows the state of the upstream side of the nip portion between the applying roller 1001 and the counter roller 1002. In this figure, the liquid adheres to the applying surface of the applying roller 1001 so as to slightly cover the fine concaves and convexes on the applying surface.

FIG. 26 shows the state of the surface of ordinary paper, the medium P, and the applying surface of the applying roller 1001, at the nip portion between the applying roller 1001 and the counter roller 1002. In this figure, the convexes on the surface of the ordinary paper, the medium P, contact with the applying surface of the applying roller 1001. The liquid instantaneously permeates through or sticks to fibers in the surface of the ordinary paper, the medium P, through the contacting parts. The liquid adhering to those parts of the applying surface of the applying roller which do not contact with the convex portions on the surface of the ordinary paper remains on the applying surface.

FIG. 27 shows the state of the downstream side of the nip portion between the applying roller 1001 and the counter roller 1002. In this figure, the medium has completely left the applying surface of the applying roller 1001. The liquid adhering to those parts of the applying surface of the applying roller 1001 which do not contact with the convex portions on the surface of the ordinary paper remains on the applying surface. The liquid on the contacting parts also remains with very small amount on the applying surface.

The application liquid remaining on the applying roller 1001 slipperily flows between the applying roller 1001 and the upper edge 2010 of the abutting member 2009 and returns to the liquid holding space S, against the pushing force of the abutting member 2009 of the liquid holding member 2001, which force acts on the applying roller 1001. The application liquid is then mixed with the application liquid filled into the space S.

Figure 10:
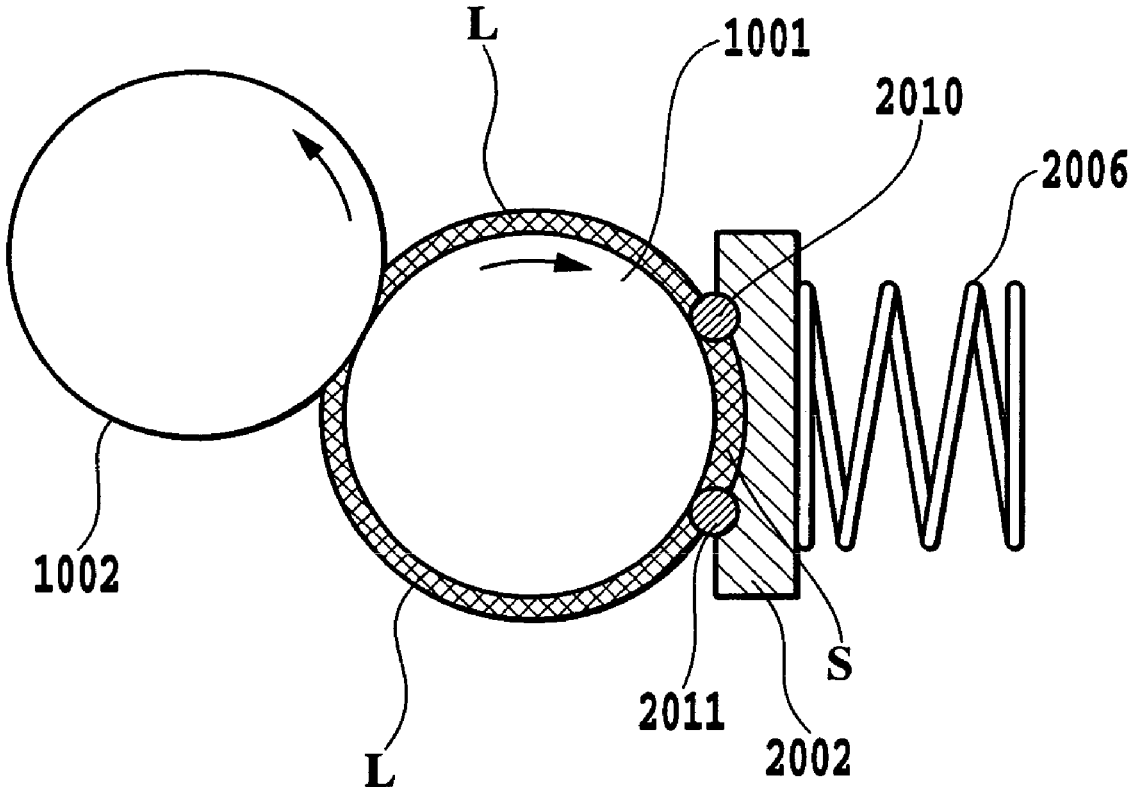
FIG. 10 is a vertical sectional view showing how the application liquid is filled into the liquid holding space formed by the liquid holding member and the applying roller and how the applying roller is rotated when no applying medium is present.

The operation of returning the application liquid is similarly performed if the applying roller 1001 is rotated while no applying medium is present as shown in FIG. 10. That is, the application liquid adhering to the outer periphery of the applying roller 1001 as a result of the rotation of the applying roller 1001 slipperily flows through the abutting portion between the applying roller 1001 and the counter roller 1002. After flowing through the abutting portion, the application liquid is separated into two parts directed to the applying roller 1001 and the counter roller 1002, respectively. The application liquid remains on the applying roller 1001. Then, the application liquid adhering to the applying roller 1001 slipperily flows between the upper edge 2010 of the abutting member 2009 and the applying roller 1001 to enter the liquid holding space S. The application liquid is then mixed with the application liquid filled into the space S.

Ending Step

Figure 18:
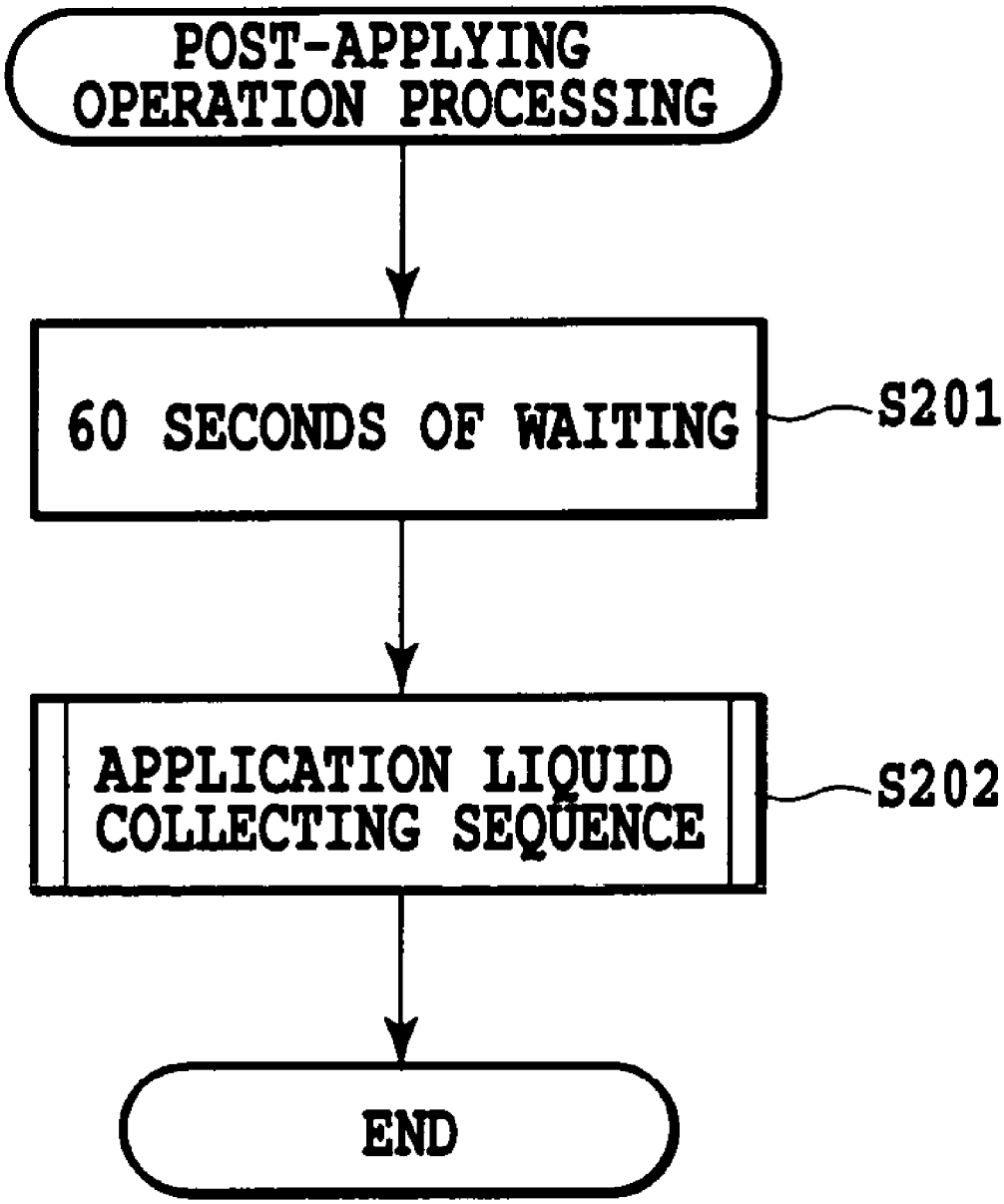
FIG. 18 is a flowchart showing an application liquid collecting process according to a first embodiment of the present invention.
Figure 19:
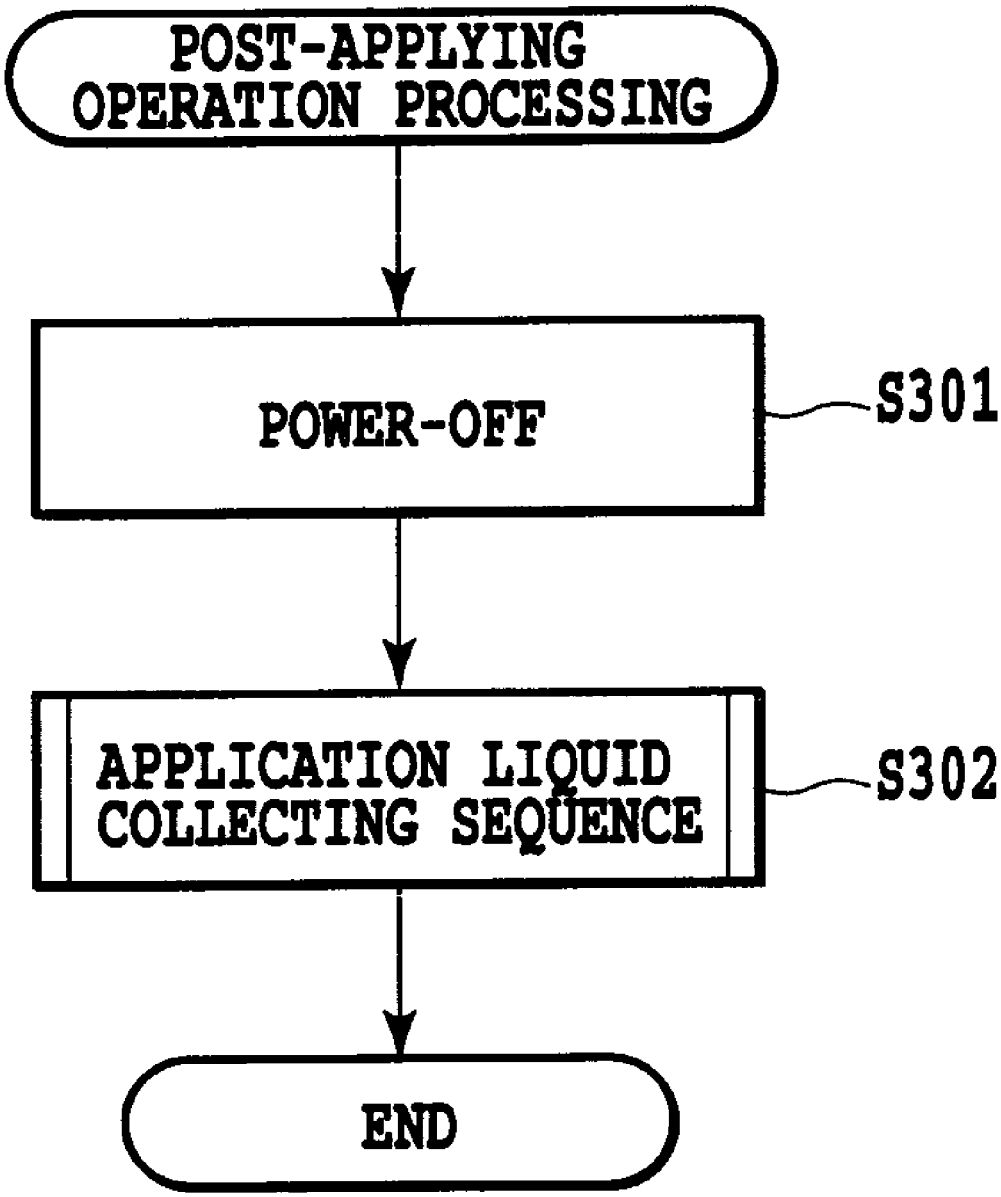
FIG. 19 is a flowchart showing an application liquid collecting process according to a second embodiment of the present invention.
Figure 20:
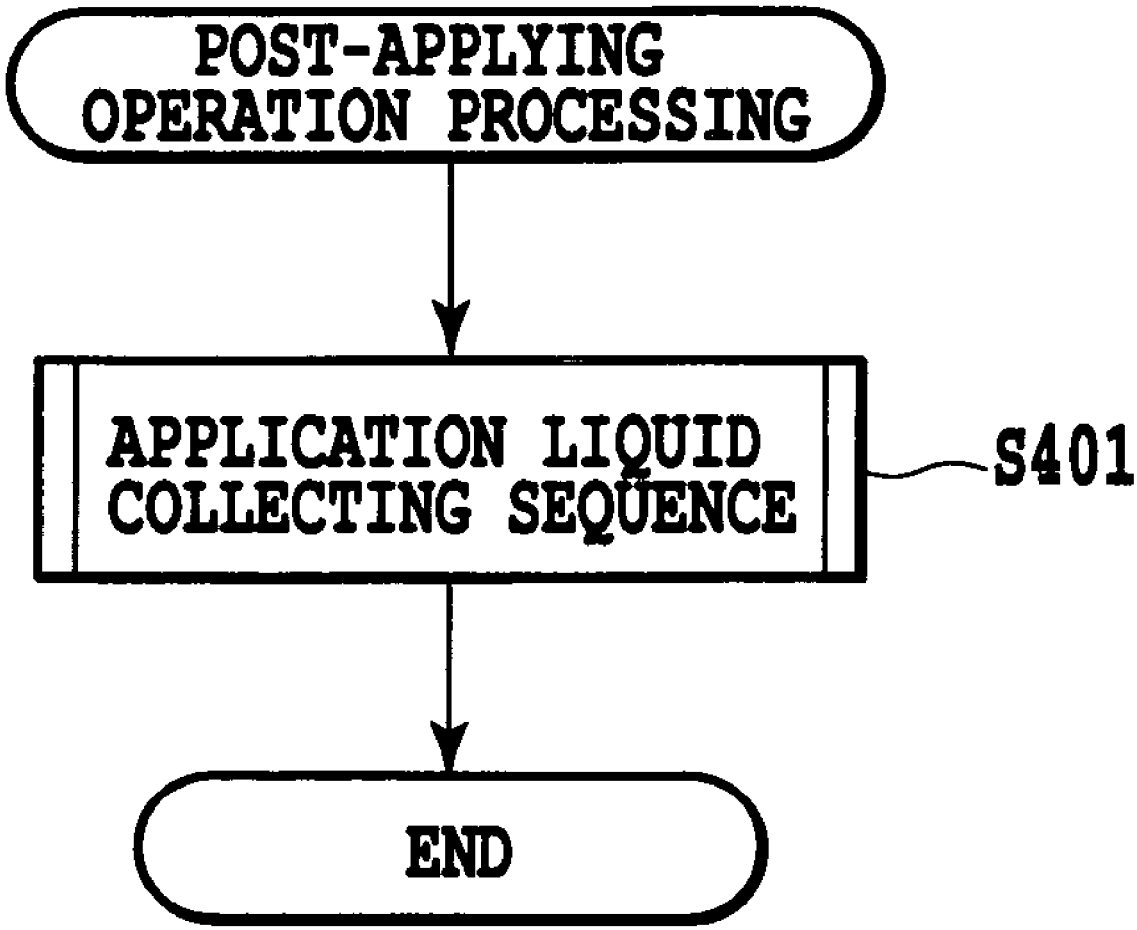
FIG. 20 is a flowchart showing an application liquid collecting process according to a fourth embodiment of the present invention.

Once the applying operation has been performed on the applying medium, it is determined whether or not to end the applying step (step S6). When the applying step is not to be ended, the process returns to step S5 to repeat the applying operation until the applying step is executed on the entire area of the applying medium which must be applied. Once the applying step has been ended, the applying roller 1001 is stopped (step S7), and the driving of the pump 3007 is stopped (step S8). Subsequently, the process shifts to step S2 to repeat the previously described operations in steps S2 to S8, if the application start instruction has been input. If the application start instruction has not been input, a post-process, which operation is described later in detail with reference to respective FIGS. 18, 19 and 20, is executed which includes a collecting operation of collecting the application liquid from the liquid holding space S and liquid channel. Thus, the processing associated with applying is finished.

Collecting Operation

Figure 24:
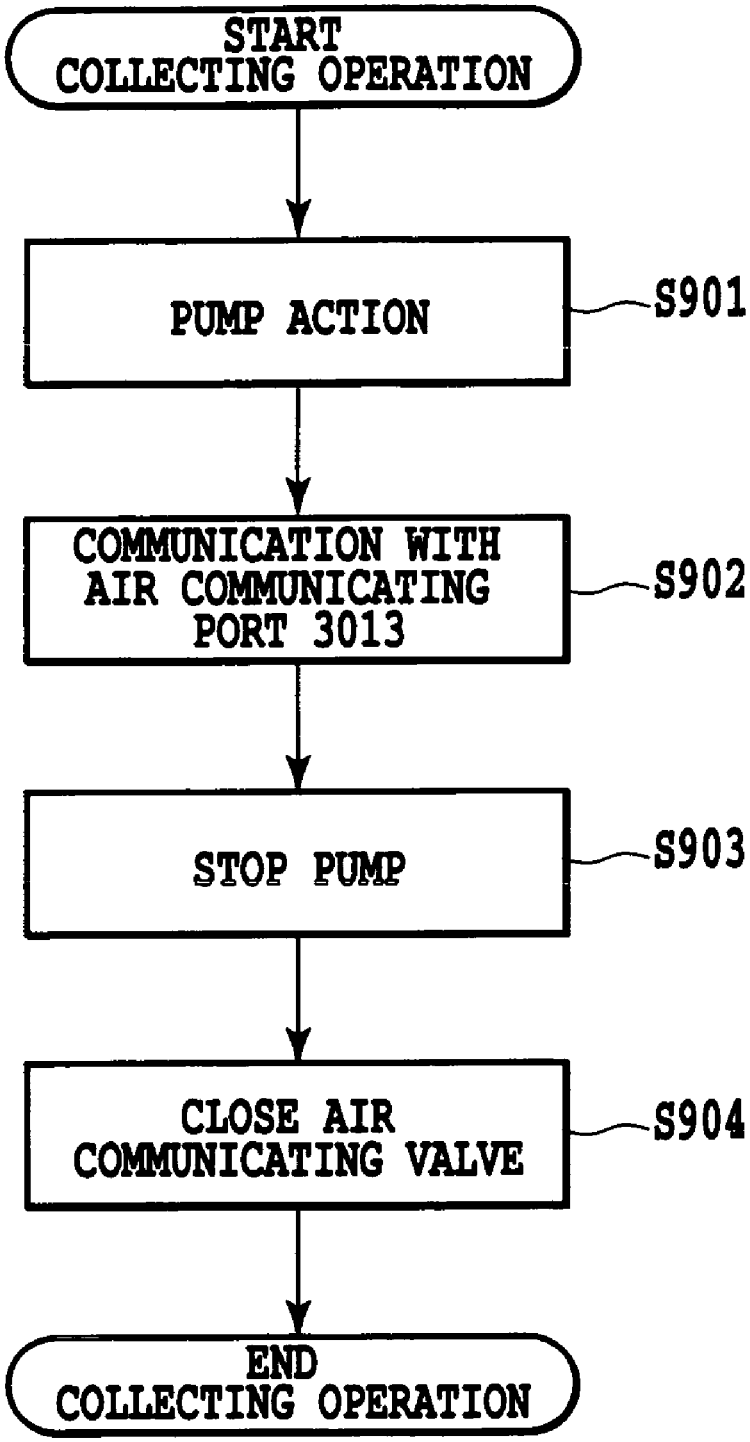
FIG. 24 is a flowchart showing the sequence of a collecting operation.

Now, with reference to FIG. 24, description will be given of an application liquid collecting operation as a part of the post-process of step S9 shown in FIG. 13. The processing shown in FIG. 24 is executed also as a application liquid collecting sequence in a post-process described in respective FIGS. 18, 19, and 20. The collecting operation is performed by, in FIG. 11, opening the air communicating valves 3005 and 3013 and driving the pump 3007 to cause the application liquid in the tube 3012 of the first channel 3001, the liquid holding space S, and the second channel 3002 to flow into the liquid storing tank 3003. This operation will be described below in detail.

Immediately before the collecting operation is started, the applying roller 1001 and the pump 3007 are in a stopped state. Further, the air communicating valve 3005 is in an opened state, and then the air communicating port 3004 is in a communicating state for the air.

When the collecting operation is started, the pump 3007 is operated in step S901 in FIG. 24 to cause the application liquid to flow in the liquid channel 3000. For example, in the second channel 3002, the application liquid flows in a direction shown by an arrow in FIG. 11.

Then, in step S902, the three-way valve 3006 is set as shown in FIG. 23 to cause the air communicating port 3013 and the liquid holding member side tube 3012 to communicate with each other. Then, since the operation of the pump 3007 has caused the application liquid to flow in the direction shown by the arrow in FIG. 11, air flows in through the air communicating port 3012 together with the flow of the application liquid. This makes the application liquid present in a path (referred to as a liquid path A below), which extends from the liquid holding member tube 3012 to the second channel 3002 and including the liquid holding space S, collected into the storage tank 3003. Further, the liquid path A is filled with air. In this state, the three-way valve 3006 has been set as shown in FIG. 23 and the storage tank tube 3011 is thus shut off from the air.

Then, in step S903, the operation of the pump 3007 is stopped, and the pump 3007 is used to shut off the second channel 3002 from the air. Finally, in step S904, the air communicating valve 3005 is closed.

With the above collecting operation, the application liquid is collected from the liquid path A if the applying operation is not performed for a predetermined period. This inhibits the application liquid from being evaporated and fixed in the liquid holding space S in the liquid path A even if the applying operation is not performed a long time. This in turn prevents defective applying caused by the fixture of the application liquid to the abutting member 2009.

Further, the collecting operation can prevent the application liquid from evaporating from the liquid holding space S. After the collecting operation, the storage tank 3003 is shut of f from the air by closing the air communicating valve 3005 and switching the selector valve 3006 to block the communication between the storage tank tube 3011 and the air communicating port 3013. It is thus possible to prevent the application liquid from evaporating from the storage tank 3003 and from flowing out if the apparatus is tilted during movement, transportation, or the like.

It is possible to omit the collecting process in step S9, described above, or the inhibition of the stoppage of the pump in preparation for the next applying operation, that is, the process of stopping the pump in step S8. In this case, the application liquid circulates through the circuit shown in FIG. 11, that is, a channel composed of the storage tank 3003, the first channel 3001, the liquid holding space S, and the second channel 3002.

Description will be given below of several embodiments relating to the operation of collecting the application liquid held in the liquid holding member, which operation is performed in the embodiments are based on an applying apparatus according to the embodiment of the present invention described above.

Embodiment 1

FIG. 18 is a flowchart showing an application liquid applying process according to a first embodiment of the present invention. This process is activated when an applying operation for one sheet of applying medium is finished. Specifically, this process if executed as a "post-process" of step S9 shown in FIG. 13.

First, in step S201, the apparatus stands by for 60 seconds with remaining the application liquid held in the liquid holding member 2001. Thus, the applying operation can be immediately started if an applying medium is subsequently fed and applied. More specifically, when a new applying instruction is given during the 60-second standby, the process shifts to step S3 shown in FIG. 13. On the other hand, when no applying instruction is given during the 60-second standby, the process shifts to step S202 to perform the application liquid collecting operation of discharging the application liquid from the liquid holding member 2001 to finish the present process. This collecting operation is as previously described in FIG. 24. Of course, the standby time is not limited to 60 seconds but may have a predetermined value prescribed according to the specifications of the apparatus or the like.

In FIG. 18, as described above, the collecting operation is started in step S202. Meanwhile, since the pump operation is stopped before this collecting operation (see S8 in FIG. 13), the pump operation must be start again before the collecting operation is started (see S901 in FIG. 24). However, the pump stopping step in step S8 in FIG. 13 is preferably omitted in view of the following: the applying operation can preferably be immediately performed if a new applying instruction is given within a predetermined period (in this case, 60 seconds), and the collecting operation can preferably be immediately performed if a new applying instruction is not given within the predetermined period (in this case, 60 seconds). In other words, after the applying roller is stopped in step S7 in FIG. 13, the process skips step S8 to shift directly to the post-process in step S9. In this case, the pump operation is still being performed when the post-process step is started. Accordingly, if the applying start signal is input within the predetermined period in step S201 in FIG. 18, which is executed as the post-process step, the process can shift to step S4 in FIG. 13 to immediately perform the applying operation. On the other hand, if the applying start signal is not input within the predetermined period, the process shifts to step S202 of FIG. 18 to perform the collecting operation shown in FIG. 24. At this time, since the pump operation is still being performed, the process can skip step S901 to shift to step S902 in FIG. 24 to immediately start the application liquid collecting operation. Thus, according to the present embodiment, upon determining that the applying operation has not been performed for a certain period since the end of the applying operation, the apparatus can collect the application liquid from the liquid holding member to avoid soaking the applying roller in the application liquid for a long period. This makes it possible to prevent the applying roller from being degraded by the application liquid. Furthermore, in the present embodiment, since the collecting operation is performed after standby for the predetermined period, upon determining that there is another applying medium to be applied, the apparatus can allow for the next applying operation without carrying out collecting. Thus, if applying is continuously executed on a plurality of media, it is possible to omit the wasteful operation of carrying out collecting and then refilling before the next applying operation. This in turn makes it possible to prevent, for example, a decrease in the throughput of the whole apparatus.

Embodiment 2

FIG. 19 is a flowchart showing an application liquid collecting process according to a second embodiment of the present invention. The process of flowchart in FIG. 19 is executed as the post-process in step S9 shown in FIG. 13.

According to the present embodiment, the apparatus determines whether or not the user has given an instruction to power of f the applying apparatus by, for example, operating corresponding keys. If the power-off instruction has been given (step S301), then the collecting operation is performed (step S302). This collecting operation is as previously described in FIG. 24.

The present embodiment is thus the same as the above embodiment in that the apparatus carries out collecting upon determining that the applying operation has not been performed for a certain period. According to the present embodiment, the criterion or factor for the determination is the giving of the instruction on the power-off of the apparatus (what is called a power-off operation).

Embodiment 3

According to the present embodiment, the collecting operation is performed if jamming occurs in the conveying path from the sheet feeding section to the sheet discharging section or if the apparatus determines that jamming has occurred in the conveying path. This collecting operation is as previously described in FIG. 24.

Figure 21:
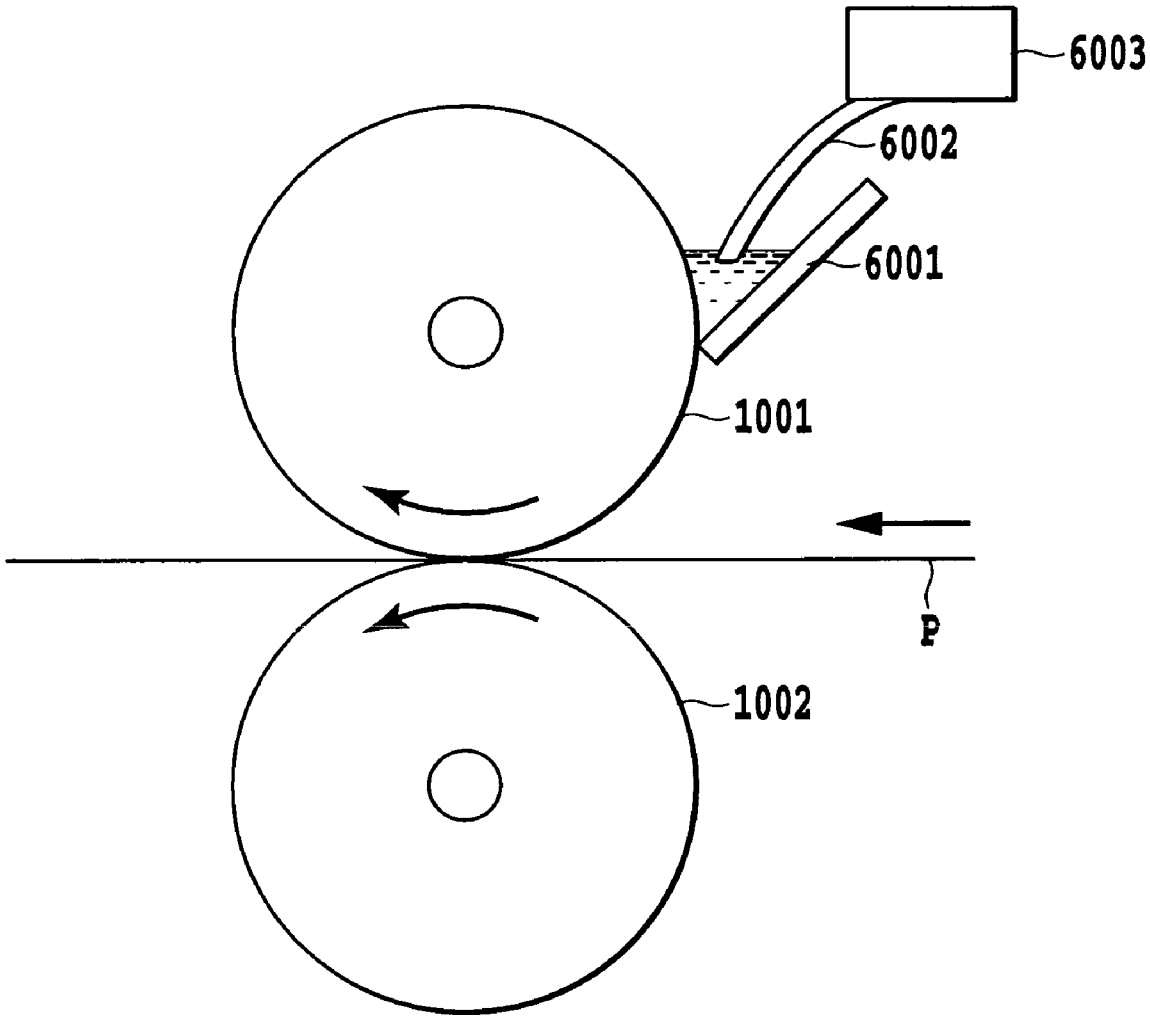
FIG. 21 is a diagram showing a form in which an application liquid is held according to another embodiment of the present invention.

If the jamming occurs, it cannot be eliminated it unless the user changes the posture of the apparatus, depending on the location of the jamming. When the posture of the apparatus is changed, if the liquid applying mechanism is as shown in FIG. 21, described later, the liquid may leak out. Thus, in the present embodiment, the collecting operation is performed if the jamming occurs or if the apparatus determines that jamming has occurred.

This configuration can avoid the possibility of causing the leakage of the liquid when the user changes the posture of the apparatus in order to eliminate jamming.

Embodiment 4

FIG. 20 is a flowchart showing an application liquid collecting process according to a fourth embodiment of the present invention.

As shown in FIG. 20, in contrast to the above two embodiments, the application liquid is collected immediately after the applying operation has been executed for one sheet of applying medium (step S401). For example, in the case that the apparatus pre-senses that the user has set the number of sheets to be applied at one, it can execute the above process. In this case, the step of stopping the pump as shown in step S8 in FIG. 13 is omitted. The collecting operation is performed by shifting from step S7 in FIG. 13, in which the pump is stopped, to step S902 in FIG. 24.

Another Embodiment

Figure 14:
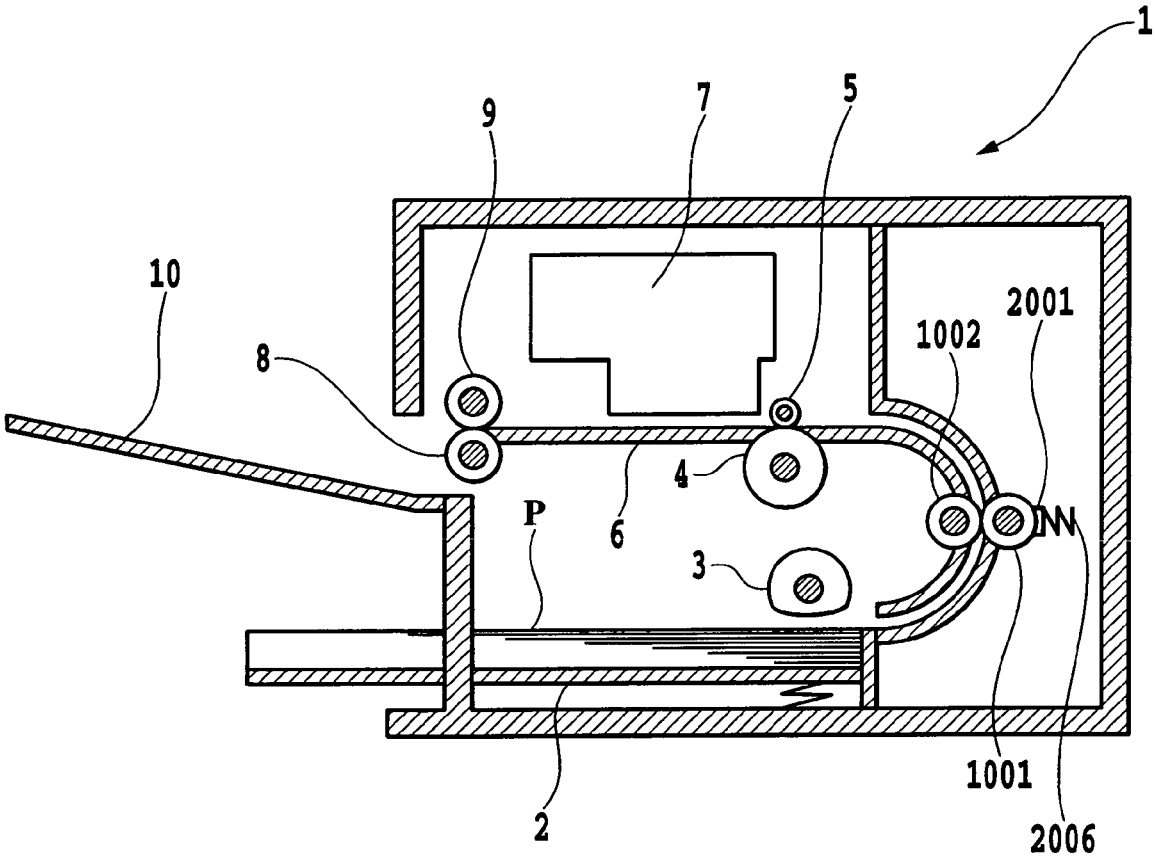
FIG. 14 is a vertical side view generally showing the configuration of an ink jet printing apparatus according to the embodiment of the present invention.

FIG. 14 is a diagram generally showing the configuration of an ink jet printing apparatus 1 comprising an applying mechanism having a configuration similar to that of the liquid applying apparatus according to the above embodiments. That is, any of the application liquid collecting processes according to the above embodiments is executed which embodiments have been respectively described in FIGS. 18 to 20, in connection with the operation of the printing section.

The ink jet printing apparatus 1 is provided with a feeding tray 2 on which a plurality of print media P are stacked. A semicircular separating roller 3 separates each print medium P from the others stacked on the feeding tray and then feeds it to a conveying path. The applying roller 1001 and the counter roller 1002 are arranged in the conveying path; the applying roller 1001 and the counter roller 1002 constitute liquid applying means of the liquid applying mechanism. The print medium P fed from the feeding tray 2 is then fed to between the rollers 1001 and 1002. The applying roller 1001 is rotated clockwise in FIG. 14 by the rotation of a roller driving motor. The applying roller 1001 applies the application liquid to a print surface of the print medium P while conveying the print medium P. The print medium P to which the application liquid has been applied is fed to between a conveying roller 4 and a pinch roller 5. Then, the conveying roller 4is rotated counterclockwise in the figure to convey the print medium P on a platen 6. The print medium P then moves to a position opposite to a print head 7 constituting printing means. The print head 7 is of an ink jet type in which a predetermined number of nozzles for ink ejection are disposed. While the print head 7 is being scanned in a direction perpendicular to the sheet of the drawing, printing is carried out by ejecting ink droplets from the nozzles to the print surface of the print medium P in accordance with print data. An image is formed on the print medium by alternately repeating a printing operation and a conveying operation performed by the conveying roller 4 to convey the print medium by a predetermined amount. Simultaneously with this image forming operation, the print medium P is sandwiched between a sheet discharging roller 8 and a sheet discharging spur 9 both provided downstream of the scan area of the print head in the conveying path for the print medium. The print medium P is then discharged onto a sheet discharging tray 10 by the rotation of the sheet discharging roller 8.

This ink jet printing apparatus may be constructed as what is called a full line type in which an elongate print head having nozzles from which inks are ejected and which are disposed over the maximum width of the print medium is used to perform a printing operation.

The application liquid used in the present embodiment is a process liquid that facilitates coagulation of pigments when inks composed of the pigments as color materials are used for printing.

In the present embodiment, the process liquid is used as an application liquid to react with the pigments, which are the color materials of the inks ejected to the print medium to which the process liquid has been applied. This facilitates the coagulation of the pigments. The facilitation of the coagulation of the pigments improves the printing density. Moreover, it is possible to suppress or prevent bleeding. The application liquid used in the ink jet printing apparatus is not limited to the above example.

Figure 15:
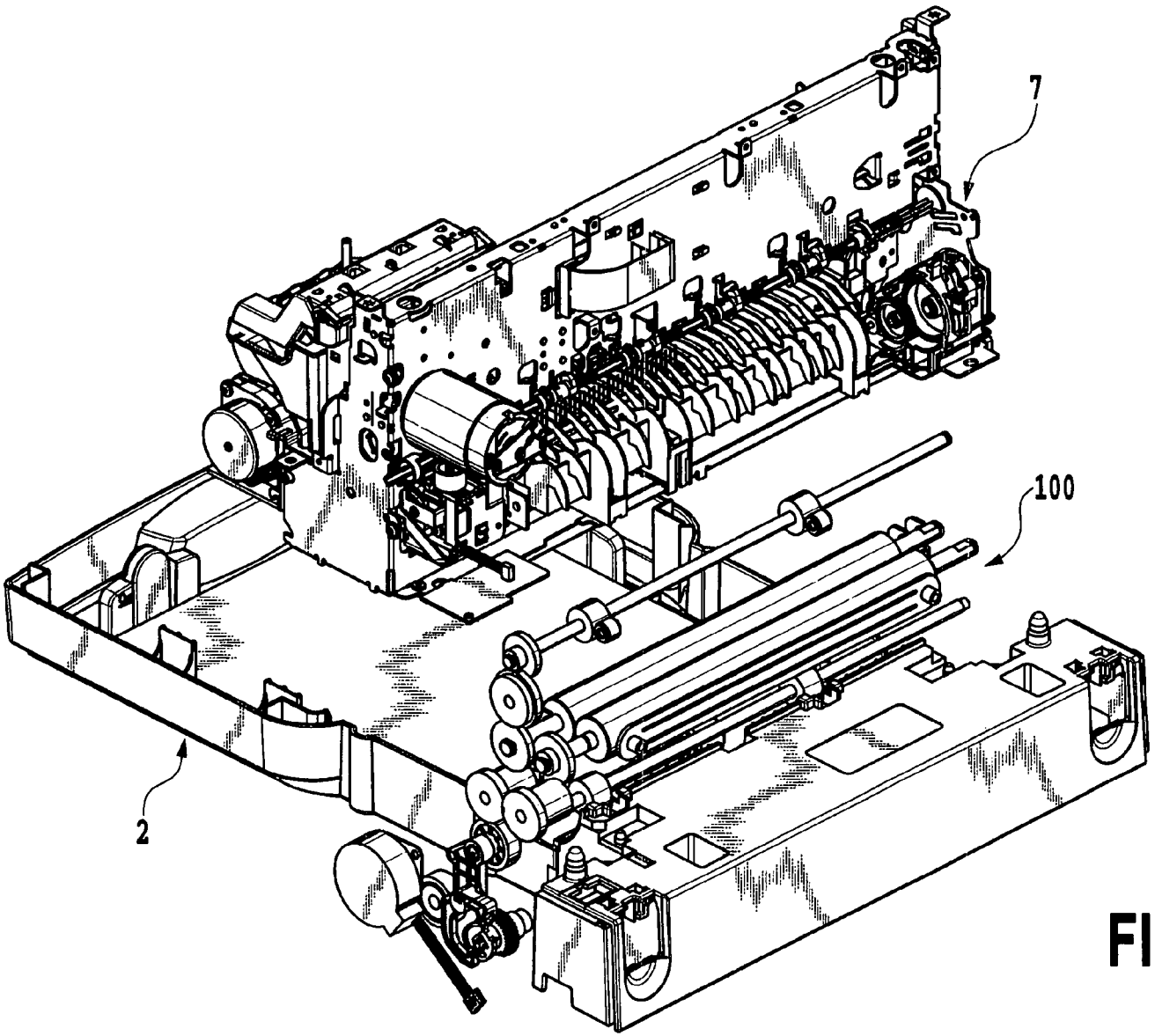
FIG. 15 is a perspective view showing how a printing section and the liquid applying apparatus are arranged if the ink jet printing apparatus according to the embodiment in FIG. 14 is configured as a serial printer type.

FIG. 15 is a perspective view showing an essential part of the above ink jet printing apparatus. As shown in the figure, an applying mechanism 100 is provided above one end of the feeding tray 2. A printing mechanism comprising the print head 7 and the like is provided above the applying mechanism 100 and above a central portion of the feeding tray 2.

Figure 16:
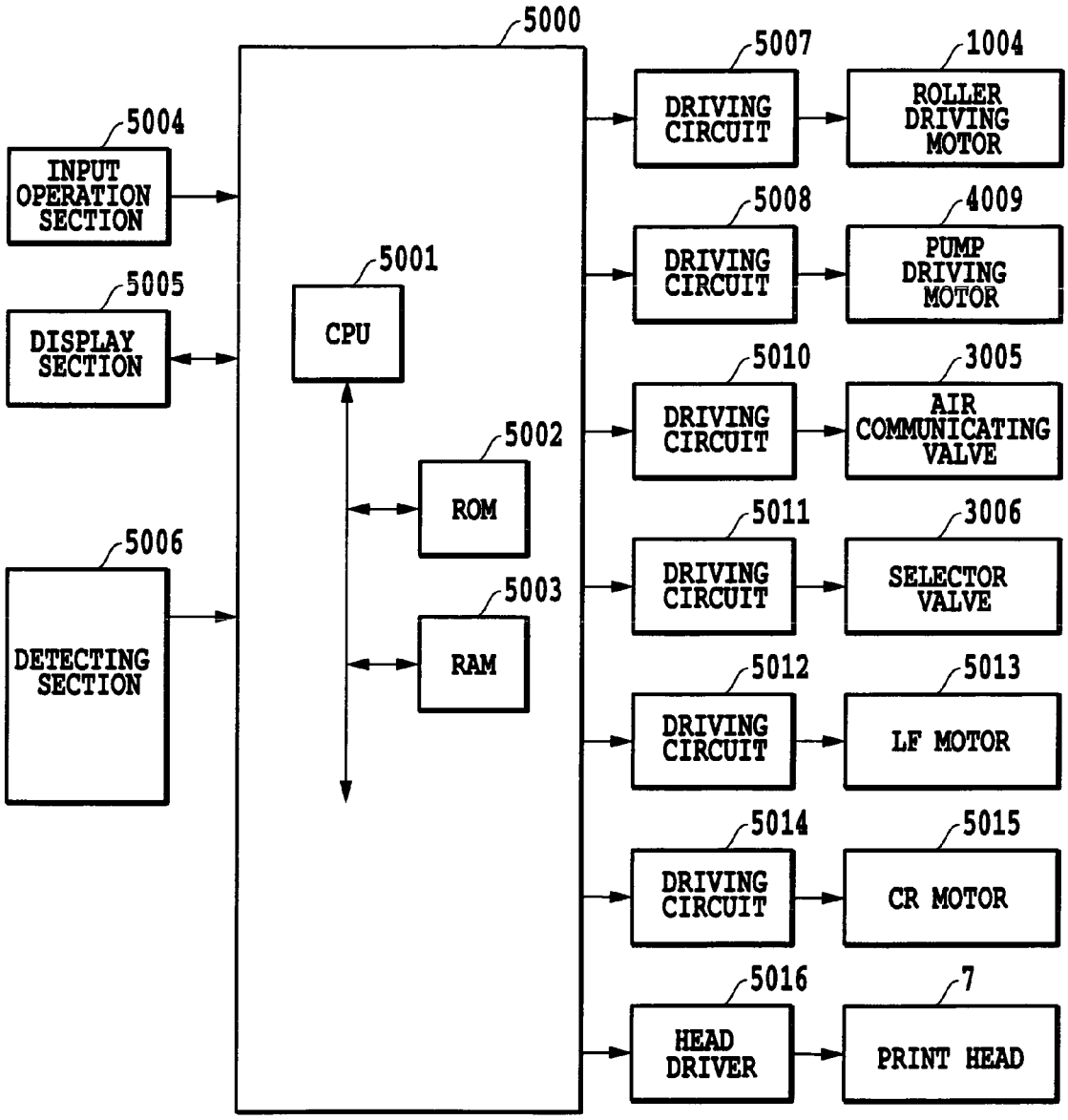
FIG. 16 is a block diagram generally showing the configuration of a control system of the ink jet printing apparatus according to the present invention.

FIG. 16 is a block diagram showing a control arrangement for the above ink jet printing apparatus. In this figure, a roller driving motor 1004, a pump driving motor 4009, and an actuator 3005 for the air communicating valve, all of which are elements of the liquid applying mechanism, are similar to those descried for the liquid applying apparatus.

In accordance with a program of a process procedure described later in FIG. 17, a CPU 5001 controls the driving of the elements of the applying mechanism. The CPU 5001 also controls the driving of an LF motor 5013, a CR motor 5015, and the print head 7 which relate to the printing mechanism, via driving circuits 5012 and 5014 and a head driver 5016. That is, driving by the LF motor 5013 rotates the conveying roller 4. Driving by the CR motor moves a carriage on which the print head 7 is mounted. Moreover, the CPU 5001 performs control such that inks are ejected through the nozzles in the print head.

Figure 17:
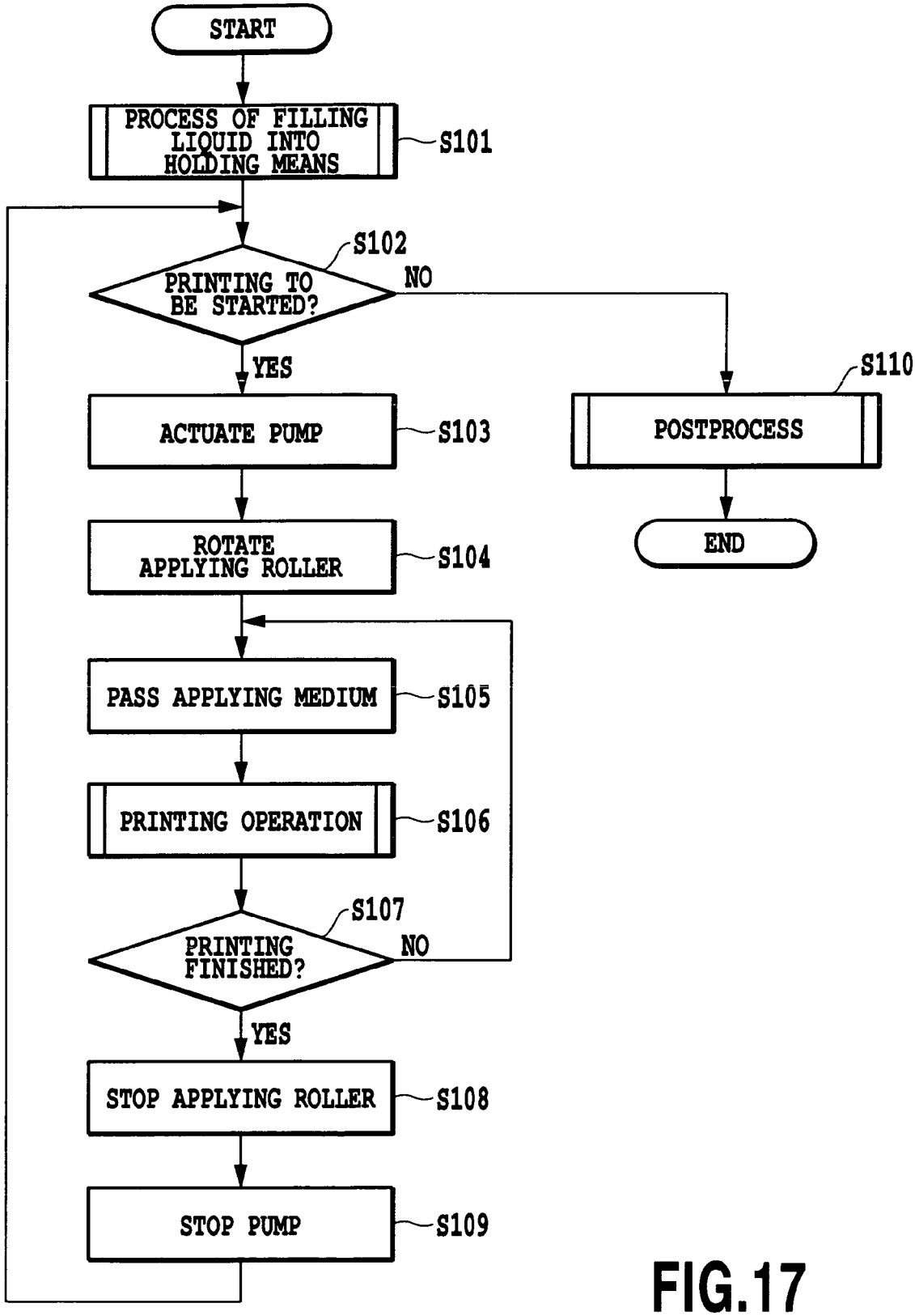
FIG. 17 is a flowchart showing the sequences of an applying operation and a printing operation according to another embodiment of the present invention.

FIG. 17 is a flowchart showing the procedure of liquid application and an accompanying printing operation in the ink jet printing apparatus according to the present embodiment. In the figure, the processing of step S101, steps S103 to S105, and steps S108 to S110 is similar to that of step S1, steps S3 to S5, and steps S7 to S9, all the steps being shown in FIG. 13. In particular, in step S110, any of the application liquid collecting processes according to the embodiments described in FIGS. 18 to 20 is respectively executed. According to the present embodiment, in step S201 in FIG. 18, the apparatus stands by for 60 seconds. When a print instruction is given during this period, the apparatus executes a process for shifting to step S103.

As shown in FIG. 17, in the present embodiment, a print start instruction is given (step S102). Then, a series of liquid applying operations such as pump activation are performed (steps S103 to S105). After this applying step, a printing operation is performed on a print medium having the application liquid applied to desired parts of the medium (step S106). That is, the print head 7 is scanned over the print medium P conveyed by the conveying roller 4 by a predetermined amount at a time. During the scan, inks are ejected from the nozzles in accordance with print data so as to be applied to the print medium to form dots. The applied inks react with the application liquid, thus improving the concentration and preventing bleeding. The conveyance of the print medium and the scanning of the print head are repeated to print the print medium P. The print finished medium is discharged onto the sheet discharging tray 10.

In the present embodiment, as the liquid is applied to the print medium, printing is sequentially executed on parts of the print medium to which the liquid has already been applied. That is, the conveying path from the conveying roller to the print head is shorter than the print medium, and when a part of the print medium to which the liquid has already been applied reaches the scan area of the print head, the applying mechanism applies the liquid to another part of the print medium. Every time the print medium is conveyed by a predetermined amount, liquid application and printing are sequentially executed on different parts of the print medium. However, in an alternative form of application of the present invention, printing may be carried out after one sheet of print medium has been completely applied with the application liquid as described in Japanese Patent Application Laid-open No. 2002-96452.

When the apparatus determines in step S107 that the printing has been finished, the processing in step S108 and the subsequent steps is executed to finish the present process.

Yet Another Embodiment

In the description of the above embodiments, the liquid holding member and the applying roller are used to form a liquid-tight space so that the application liquid can be held in this space. Then, while the applying operation is not performed, the application liquid is collected from the space. However, the form in which the application liquid is held is not limited to this. Any form may be used.

FIG. 21 is a diagram showing an example of such a form. In the form shown in FIG. 21, the applying roller 1001 and a doctor blade 6001 are used to form a space in which the application liquid is held. As the applying roller 1001 rotates, the application liquid held is supplied or applied to the surface of the applying roller 1001. As rotated, the applying roller 1001 to the surface of which the application liquid has been supplied or applied applies the application liquid to the applying medium P. With this arrangement, a supply/collecting device 6003 supplies the application liquid, via a liquid path 6002, to the space formed by the doctor blade 6001 and applying roller 1001. The supply/collecting device 6003 also collects the application liquid from the space. The supply/ collecting device 6003 comprises a pump, a storage tank, and the like. In this form, any of the collecting processes shown in FIGS. 18 to 20 can also be executed in order to collect the application liquid.

In this description, the single liquid channel 6002 has both functions of a supply and collecting paths. However, the supply and collecting paths may be separately provided as in the case of the above embodiments.

In the description of the above embodiments, if the applying roller, serving as an applying member, is soaked in the application liquid, the application liquid is collected. However, as is apparent from the above description, the present invention is applicable to a configuration in which a roller soaked in the liquid is different from the applying roller and in which the applying roller is supplied with the liquid pumped by the roller soaked in the liquid, as described in, for example, Japanese Patent Laid-Open No. 2002-96452. In the present specification, if a combination of a plurality of rollers or the like is used to pump and apply the liquid, the "applying member" also includes the set of the plurality of rollers or the like.

In the description of the above embodiments, the application liquid is collected from the liquid holding member and then collected in a container such as the storage tank. However, the present invention is not limited to such collecting but includes a configuration in which the application liquid is disposed of. That is, any form is available in which the liquid is discharged from the liquid holding member.

Further, in the description of the above embodiments, if the apparatus carries out collecting upon determining that the applying operation has not been performed for a certain period, the criterion or factor for the determination is whether or not the predetermined time of 60 seconds has elapsed or whether or not the apparatus has been powered off. However, of course, the determination criterion is not limited to this. For example, collecting may be carried out when the applying operation is interrupted for a specified period, due to a predetermined operation such as a supplying operation of the applying medium. Further, for the printing apparatuses shown in the other embodiments, the determination criterion may be specified in accordance with the specifications of the apparatus, the user's settings, or the like; for example, collecting may be carried out when a host apparatus has not sent data to the printing apparatus for a specified period.

Moreover, in the application liquid collecting processes shown in FIGS. 18 to 20, the abutment of the liquid holding member and counter roller on the applying roller is not cleared after the application liquid has been collected. However, the abutment may be cleared after the collecting. In this case, the present invention is not limited to the clearing of the abutment, that is, separation. Specifically, the force exerted for the abutment may be weakened instead of separating the liquid holding member and counter roller from the applying roller.

Moreover, the applying member transferring and applying the application liquid held in the liquid holding member to the applying medium is not limited to the applying roller. The applying member may be a belt-like member such as an endless belt.

In the above embodiments, by way of example, the liquid is applied in the ink jet printing-based printing apparatus. However, the present invention is applicable to printing apparatuses based on other systems. For example, the degree of whiteness of the medium can be improved by using a liquid containing a fluorescent whitening agent as an application liquid. Further, as further another applying liquid, a liquid containing a component suppress a curl of the applying medium (phenomenon that a medium bends to form a curvature) may be employed. The printing means used after the liquid application is not limited to the ink jet printing system. Effects can be produced using a printing system such as a thermal transfer system or an electro-photographic system. Alternatively, in a silver photography-based printing apparatus, a photosensitive agent may be applied as an application liquid before printing.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2004-035806 filed Feb. 12, 2004, which is hereby incorporated by reference herein.

What is claimed is:

1. A liquid applying apparatus, comprising:

conveying means for conveying a medium in a medium conveying path;

a liquid holding member for holding a liquid;

an applying roller for applying the liquid held in the liquid holding member to the medium conveyed by the conveying means; and discharging means for discharging the liquid held in the liquid holding member, wherein the discharging means discharges the liquid from the liquid holding member when a jam of the medium is detected in the medium conveying path.

2. An ink jet printing apparatus for ejecting an ink to a print medium, comprising:

conveying means for conveying the print medium in a conveying path;

a liquid holding member for holding a liquid different from the ink;

an applying roller for applying the liquid held in the liquid holding member to the print medium conveyed by the conveying means; and discharging means for discharging the liquid held in the liquid holding member, wherein the discharging means discharges the liquid from the liquid holding member, when a jam of the print medium is detected in the conveying path.

3. An ink jet printing apparatus according to claim 2, wherein the liquid includes a component which insolubilizes or coagulates a color material in the ink.

4. An ink jet printing apparatus comprising:

conveying means for conveying a print medium in a conveying path;

applying means comprising an applying roller for applying a liquid that reacts with an ink to the print medium conveyed by the conveying means and a liquid holding member for holding the liquid in a liquid holding space formed by contact between the applying roller and the liquid holding member, the applying means applying the liquid in the liquid holding space to the print medium through the applying roller;

means for ejecting the ink to the print medium to which the liquid has been applied by the applying means;

a liquid tank;

a first path for connecting the liquid holding member and the liquid tank to supply the liquid from the liquid tank to the liquid holding space;

a second path for connecting the liquid holding member and the liquid tank to discharge the liquid from the liquid holding space to the liquid tank; and discharging means for discharging the liquid in the first path, the liquid in the liquid holding space and the liquid in the second path into the liquid tank when a jam of the print medium is detected in the conveying path.

* * * * *